US006439486B1

(12) United States Patent
Nitta et al.

(10) Patent No.: US 6,439,486 B1
(45) Date of Patent: Aug. 27, 2002

(54) METHOD AND APPARATUS FOR DISPOSING OF WASTE

(75) Inventors: Yoshiaki Nitta; Hideo Kunioku, both of Hokkaido (JP)

(73) Assignee: Kotobuki Sangyo Kabushiki Kaisha, Sapporo (JP)

( * ) Notice: Subject to any disclaimer, the term of this patent is extended or adjusted under 35 U.S.C. 154(b) by 0 days.

(21) Appl. No.: 09/564,867

(22) Filed: May 4, 2000

(30) Foreign Application Priority Data

| | | |
|---|---|---|
| May 17, 1999 | (JP) | 11-135232 |
| May 28, 1999 | (JP) | 11-149845 |
| Jun. 28, 1999 | (JP) | 11-181491 |
| Nov. 16, 1999 | (JP) | 11-324884 |

(51) Int. Cl.[7] ..... B02C 18/16

(52) U.S. Cl. ..... 241/29; 241/80; 241/159; 241/236; 241/264; 241/294; 241/DIG. 31

(58) Field of Search ..... 241/80, 97, DIG. 31, 241/236, 294, 264, 30, 29, 159, 74

(56) References Cited

U.S. PATENT DOCUMENTS

| | | | | |
|---|---|---|---|---|
| 3,931,935 A | | 1/1976 | Holman | |
| 4,052,013 A | | 10/1977 | Ehrlich et al. | |
| 4,134,556 A | | 1/1979 | Ehrlich et al. | |
| 4,156,508 A | | 5/1979 | Kisielewski | |
| 4,394,983 A | | 7/1983 | Ulsky | |
| 4,535,941 A | | 8/1985 | Brubaker et al. | |
| 4,726,530 A | | 2/1988 | Miller et al. | |
| 4,844,350 A | * | 7/1989 | Larsson | 241/DIG. 31 |
| 5,195,684 A | * | 3/1993 | Radzins | 241/294 |
| 5,411,216 A | | 5/1995 | O'Keefe | |
| 5,511,729 A | | 4/1996 | Husain | |
| 5,624,078 A | | 4/1997 | Bredlbeck | |
| 5,678,773 A | | 10/1997 | Takamura et al. | |
| 5,735,471 A | | 4/1998 | Muro | |
| 5,772,133 A | | 6/1998 | Hall | |
| 5,785,263 A | * | 7/1998 | Wu et al. | 241/294 |
| 5,904,305 A | | 5/1999 | Kaczmarek | |

FOREIGN PATENT DOCUMENTS

| | | |
|---|---|---|
| CN | 86209112 | 6/1997 |

* cited by examiner

*Primary Examiner*—Mark Rosenbaum
(74) *Attorney, Agent, or Firm*—Kanesaka & Takeuchi

(57) ABSTRACT

In a method for disposing of waste matter such as waste tire pieces by using first and second shredding members each having shredding blades, the waste matter is introduced into a space between the shredding blades of the first and second shredding members and shredded or torn off into fine chips by operating the first and second shredding members, while partially caught by grooves formed in opposite faces of the shredding blades of the respective shredding members. By moving the first and second shredding members relative to each other in opposite directions to impart a shearing force to the waste matter in the space between the shredding blades, the waste matter is effectively torn off into pieces. When a waste tire is processed in an apparatus for practicing the method, it is successfully separated into rubber parts and wires with high efficiency.

16 Claims, 24 Drawing Sheets

METHOD AND APPARATUS FOR DISPOSING OF WASTE

BACKGROUND OF THE INVENTION

1. Field of the Invention

This invention relates to a method for disposing of various wastes such as scrapped cars, car part, household electrical appliances, large household furniture, containers and machines, and an apparatus therefor.

2. Description of the Prior Art

For instance, a waste tire is being recycled by being decomposed into several parts, e.g. rubber component and wire embedded in the rubber component. In order to recycle the rubber component of the waste tire, the waste tire is first cut into some pieces in a preliminary process, and then, broken into small chips by using a shredding device.

In a conventional method of disposing of waste tires by use of a shredding device as shown in FIGS. 30A and 30B, a piece T1 of a waste tire made of rubber and wire W such as a belt wire embedded in the tire piece T1 is torn off into chips T1*a* and T1*b* with cutter blades C1 and C2. As the rubber component of the waste tire is torn off, the wire W is simultaneously cut into wire fragments left in the chips T1*a* and T1*b*. To automatically remove the wire fragments from the tire chips T1*a* and T1*b* after shredding the waste tire with the shredding device, the tire chips are repeatedly subjected to pulverization until they turn into particles on the order of several millimeters. As a result, the wire fragments are finally extracted from the pulverized particles resultantly obtained, consequently to separate the waste tire pieces into rubber components and wires.

Thus, the waste tire is generally shredded into small fragments because the wire pieces W possibly left in the rubber components entail the risk of deteriorating the quality of a recycled matter such as raw rubber. It goes without saying that the recycled matter free from wires or other foreign substances is desirable from the standpoint of actual application.

However, the conventional method of disposing of waste tires as noted above has suffered a disadvantage such that the number of repetitions of shredding waste tire chips is inevitably increased until the waste tire is completely torn off into destined small pieces. As a result, the work of disposing of the waste tire requires much time and labor, and the shredding device suffers from early consumption of the cutter blades and involves extra cost for maintenance. Besides, the shredded tire chips finally obtained are considerably small and therefore, restricted in use to lower the usage value thereof.

OBJECT OF THE INVENTION

An object of the present invention is to provide a method and apparatus capable of swiftly disposing of a waste matter.

Another object of the present invention is to provide a method and apparatus capable of disposing of a waste matter at a low cost.

Still another object of the present invention is to provide a method and apparatus for efficiently shredding a waste matter into pieces and spreading the use and recycling of the shredded pieces.

Yet another object of the present invention is to provide a method and apparatus for facilitating separation between different materials of a waste matter, e.g. separation of metal from rubber.

SUMMARY OF THE INVENTION

To attain the objects described above according to the present invention, there is provided a method for disposing of a waste matter, which comprises placing the waste matter such as a waste tire in a space between shredding blades of first and second shredding members, and relatively moving the first and second shredding members in opposite directions so that the waste matter is subjected to shearing force exerted in opposite directions and torn off into pieces by the shredding blades relatively moving in opposite directions. In a shredding process, the waste matter placed in the space between the shredding blades is firmly caught by grooves formed in the opposed blade surfaces of the shredding blades.

Any form of the waste matter to be disposed of may be placed in the aforesaid space in the shredding process. That is, the whole or part of raw waste matter to be shredded or shredded piece or pieces of the waste matter may be placed therein. The form of the waste matter to be dealt with includes a part of the shredded piece or pieces and a part connected to an incompletely shredded waste matter. Since the shredding blades are cooperatively worked to shred the waste matter into pieces while seizing the waste matter therebetween, pulverization can be performed efficiently, and even foreign substance such as metal wires embedded in a waste tire can easily be removed from the shredded pieces of the waste matter.

An apparatus for disposing of waste matter according to the present invention comprises a shredding section including first and second shredding members which relatively move in opposite directions. The shredding blades of the first and second shredding members are cooperatively worked to shred the waste matter to be disposed of. Between the shredding blades of the first and second shredding members, there is formed a space for letting the waste matter thereinto and dealing with the waste matter therewithin. Each shredding blade has a groove in its blade surface, which is opposite to that of the counterpart shredding blade, so as to bite the waste matter to be torn in the space defined between the blade surfaces.

The first and second shredding members may be relatively rotatable in their face-to-face directions. One of the first and second shredding members is stationary, and the other shredding member is movable and driven by a drive means so as to move along the opposed blade surface of the aforesaid one. Otherwise, the movable shredding member may be rotated by the drive means along the opposed blade surface of the stationary shredding member.

The waste matter, which is placed in the space between the blade surfaces of the shredding members and caught by the grooves formed in the opposed blade surfaces of the shredding members, is subjected to the shearing action brought about by moving the shredding blades of the shredding members in opposite directions. Consequently, the method of the present invention makes it possible to efficiently shred, for instance, a waste tire constituted by steel wire and rubber components into small pieces, and then, easily separate only the steel wire parts embedded in the shredded pieces from rubber components. Thus, the waste matter such as the scrap waste tire can be easily disposed of with high efficiency.

Since the waste matter placed in the space between the shredding blades is efficiently broken up with the cooperation of the grooves formed in the shredding blades to easily remove even foreign substance such as metal wires embedded in a waste tire from the shredded pieces of the waste tire, the labor required to tear off the waste matter can be abridged and the efficiency and rationality of fulfilling disposal of waste matter can be enhanced.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

One embodiment of the method for disposing of a waste matter such as a waste tire according to the present invention will be described hereinafter with reference to FIG. 1 through FIG. 3.

Figure 1A:
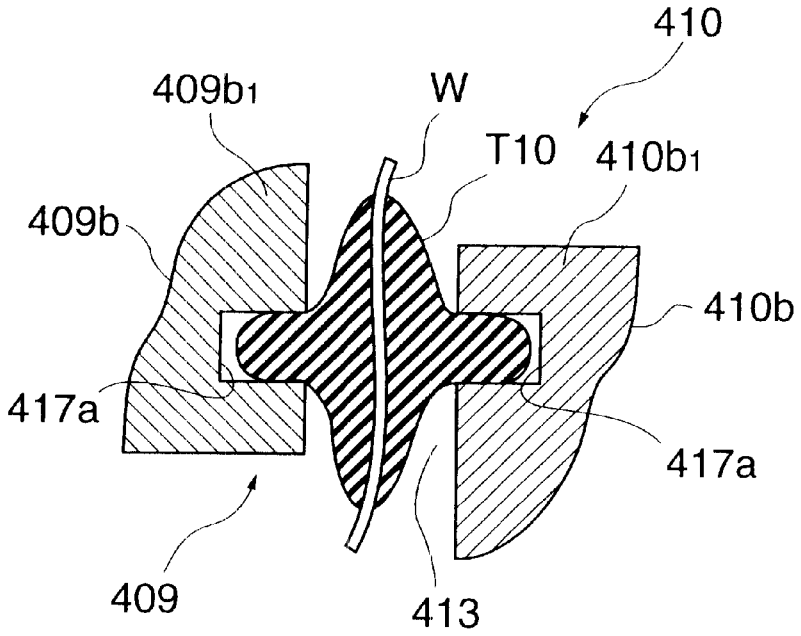
FIGS. 1A and 1B are cross-sectional views showing a process of shredding a waste matter into pieces in a first embodiment of the method according to this invention.
Figure 1B:
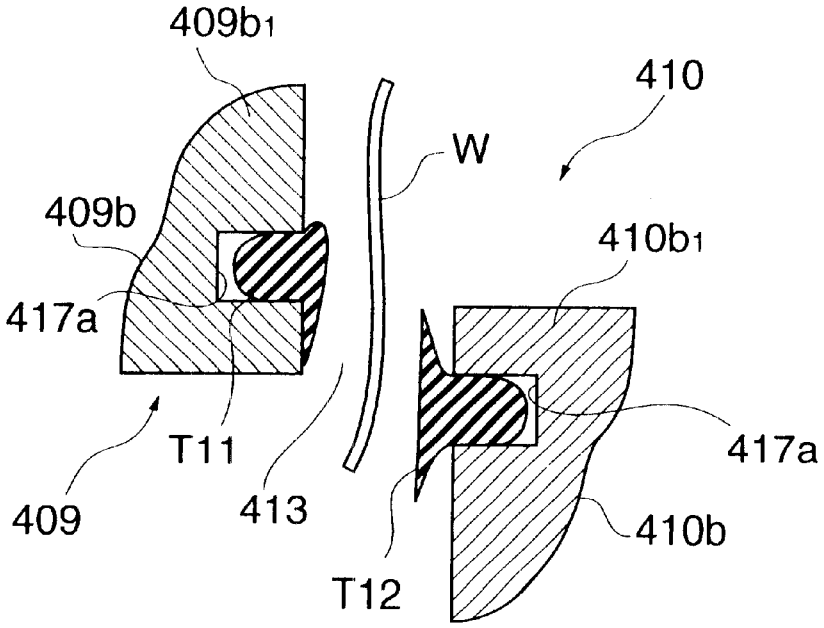

The disposing method according to the invention serves to extract wires W from rubber components into which the entire or part of a waste tire piece is shredded by first and second shredding members 409 and 410 in a space 413 formed between the shredding blades 409*b* and 410*b* of the first and second shredding members 409 and 410, as shown in FIGS. 1A and 1B.

To be more specific, the waste tire piece T10 is squeezed into the space 413 of a predetermined size formed between the blade element 409*b*1 of the shredding blade 409*b* of the first shredding member 409 and the blade element 410*b*1 of the shredding blade 410*b* of the second shredding member 410. The waste tire piece T10 squeezed into the space 413 partially comes into grooves 417*a* formed in opposite blade surfaces (right- and left-side surfaces in the attached drawings) of the blade elements 409*b*1 and 410*b*1. The waste tire piece T10 is torn off into chips by moving the blade elements 409*b*1 and 410*b*1 in opposite directions relative to each other. Since the waste tire piece T10 is distorted and dislocated owing to shearing action caused by relatively moving the shredding blades in opposite directions, wires W embedded in the waste tire are extracted from rubber portions of the shredded chips.

The method for disposing of a waste tire according to the invention will be described more concretely.

It is necessary to take different measures to deal with the waste tire according to conditions such as a shape and size of the waste tire piece T10 to be shredded and a posture of the waste tire piece in the space 413. There are typical three situations wherein a waste tire containing a wire is dealt with according to the conditions, as follows.

The explanation about the first situation will be made hereinafter with reference to FIGS. 1A and 1B.

In this situation, it is supposed that a waste tire piece T10 having a wire W extending substantial parallel to the opposite blade surfaces of the shredding blades 409*b* and 410*b* is introduced into the space 413, as shown in FIG. 1A Upon placing the waste tire piece T10 with the wire W into the space 413, both side portions of the waste tire piece T10 partially come into the grooves 417*a* in the compressed state, that is, the tire piece is caught by the grooves 417*a*.

When then moving the shredding blades 409*b* and 410*b* in opposite directions, the blade elements 409*b*1 and 410*b*1 gradually approach each other and move away from each other after they confront each other. When the shredding blades 409*b* and 410*b* move away from each other, the waste tire piece T10 caught by the grooves 417*a* is drawn by the grooves 417*a* in opposite directions, thus being torn into cut chips T11 and T12. Simultaneously, the wire W is extracted as shown in FIG. 1B.

Thus, the waste tire T10 is effectively separated into rubber components and wire W due to the grooves 417*a* by which the waste tire piece can be firmly caught.

Next, the second situation will be described with reference to FIG. 2A and FIG. 2B.

In this situation, it is supposed that the waste tire piece T10 having the wire W extending across the space 413 is placed in such a state that both end portions of the waste tire piece come into the respective grooves 417*a* in the compressed state.

In the process of moving the shredding blades 409*b* and 410*b* in opposite directions, the blade elements 409*b*1 and 410*b*1 gradually approach each other and move away from each other after they confront each other. When the shredding blades 409*b* and 410*b* move away from each other, the waste tire piece T10 caught by the grooves 417*a* is drawn by the grooves 417*a* in opposite directions, thus being torn into cut chips T13 and T14. Simultaneously, one end part of the wire W is drawn out from one of the cut chips, T14, as illustrated in FIG. 2B.

The cut chip T13 with the wire W is again dealt with to be torn by a shredding device 1 of the waste disposing apparatus according to the invention, which will be described below.

Figure 3A:
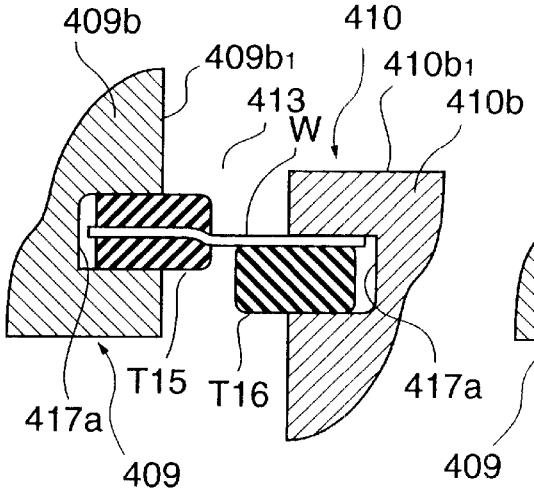
FIGS. 3A and 3B are cross-sectional views showing a process of shredding a waste matter into pieces in a third embodiment of the method according to this invention.
Figure 3B:
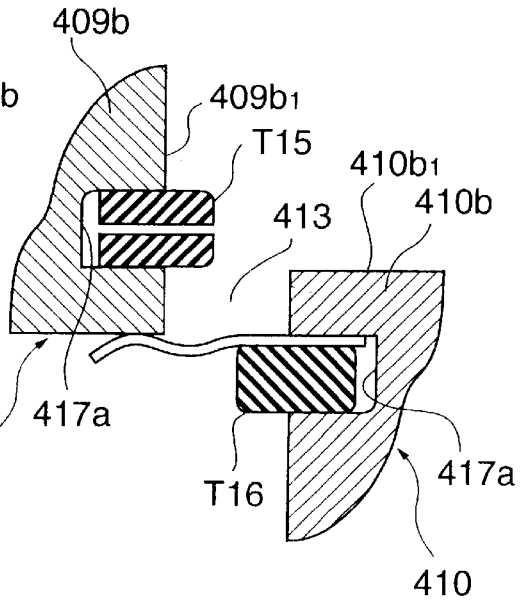
Figure 4:
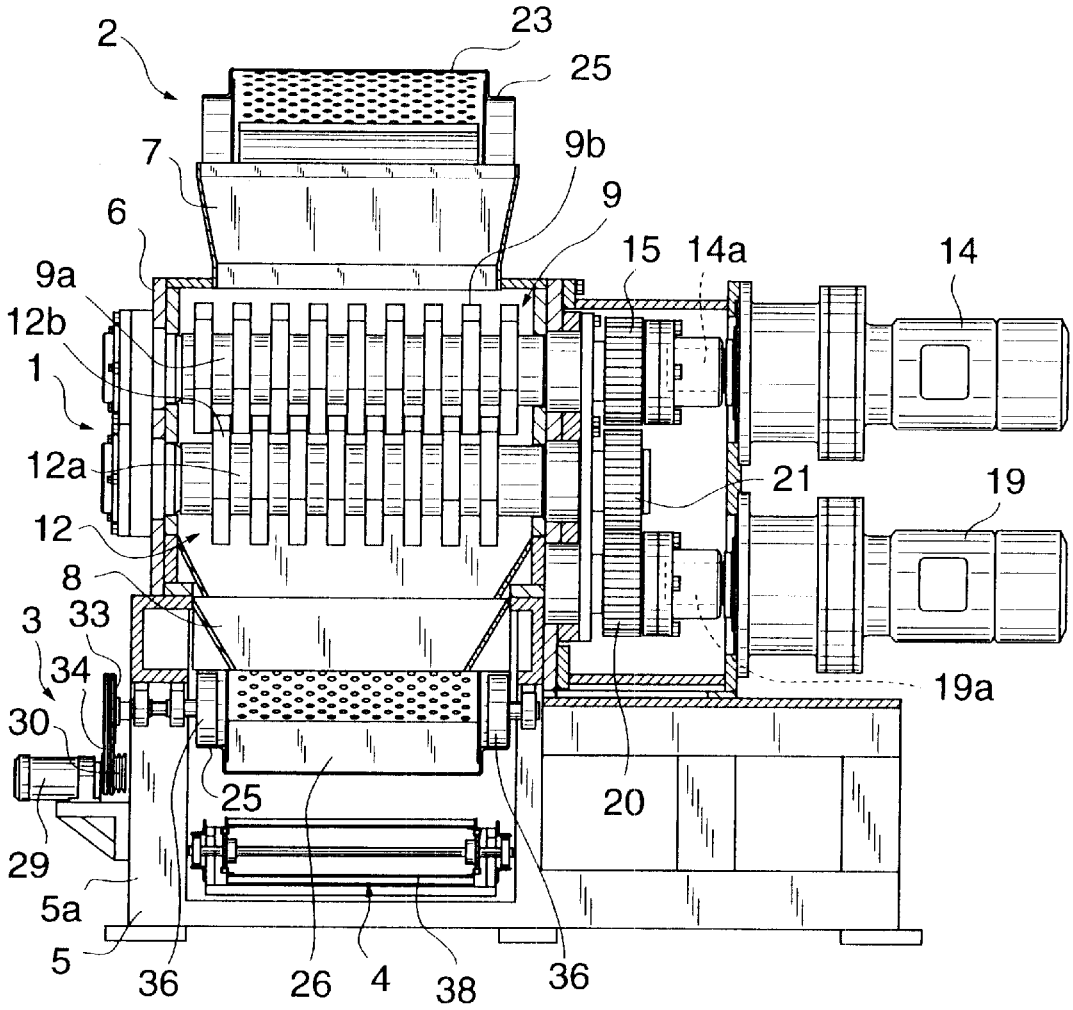
FIG. 4 is a partly cutaway front view of the apparatus according to this invention in operation.

The following is the third situation in which cut chips with a wire W are brought back to the shredding device as shown in FIG. 4. The cut chips with the wire W are introduced in the space 413 between shredding blades 409*b* and 410*b* in such a state that one of the cut chips, T15, comes into the groove 417*a* of the shredding blade 409*b* and the other cut chip T16 comes into the groove 417*a* of the shredding blade 410*b*, as illustrated in FIG. 3A. By relatively moving the shredding blades 409*b* and 410*b* in the manner as described above, the wire W held between the grooves 417*a* of the shredding blades 409*b* and 410*b* can be separated from one of the shredding blade 409*b* and 410*b* as shown in FIG. 3B.

As is also understood from the foregoing description with respect to the first and second situations, shearing of the rubber component of the waste tire piece T10 into chips and extraction of the wire from the rubber component are performed at one time.

That is, the waste tire piece T10 is torn with the cooperation of the blade elements 409*b*1 and 410*b*1. Since the shearing force is caused by stresses acting in opposite directions along the cut surface of the waste tire piece T10 seized by the blade elements in the space 413, the waste tire piece T10 is drawn in opposite directions at both side portions and torn into two, thus to break engagement between the wire and rubber component constituting the tire. As a result, the joined wire and rubber components are separated from each other. In the process of breaking the waste tire piece into chips, the grooves 417*a* formed in the opposite shredding blades serve to firmly bite the rubber components on both sides of the waste tire piece as illustrated, so as to forcibly tear off the waste tire piece caught steadily by the grooves by moving the right and left blade elements 410*b*1 and 409*b*1 upward and downward in opposite directions (vertical direction in the attached drawings). Consequently, the right and left parts of the waste tire piece T10 caught firmly by the grooves 417*a* of the blade elements are drawn up and down in opposite directions by the blade elements 410*b*1 and 409*b*1 moving in opposite directions, so that the waste tire piece can be effectively torn into chips. Owing to the grooves 417*a*, engagement between the rubber component of the tire and the wire embedded in the rubber component can more easily be released to smoothly extract the wire from the rubber component.

The cut chips T15 and T16 into which the waste tire piece is broken beforehand as shown in the aforementioned second situation are again put into the space 413 between the shredding blades 409*b* and 410*b* and caught by the grooves 417*a* as shown in the aforementioned third situation, thus to effectively extract the wire W from the rubber components of the waste tire piece.

Next, the shredding device for carrying out the method for disposing of waste tires as described above will be explained hereinafter.

Figure 5:
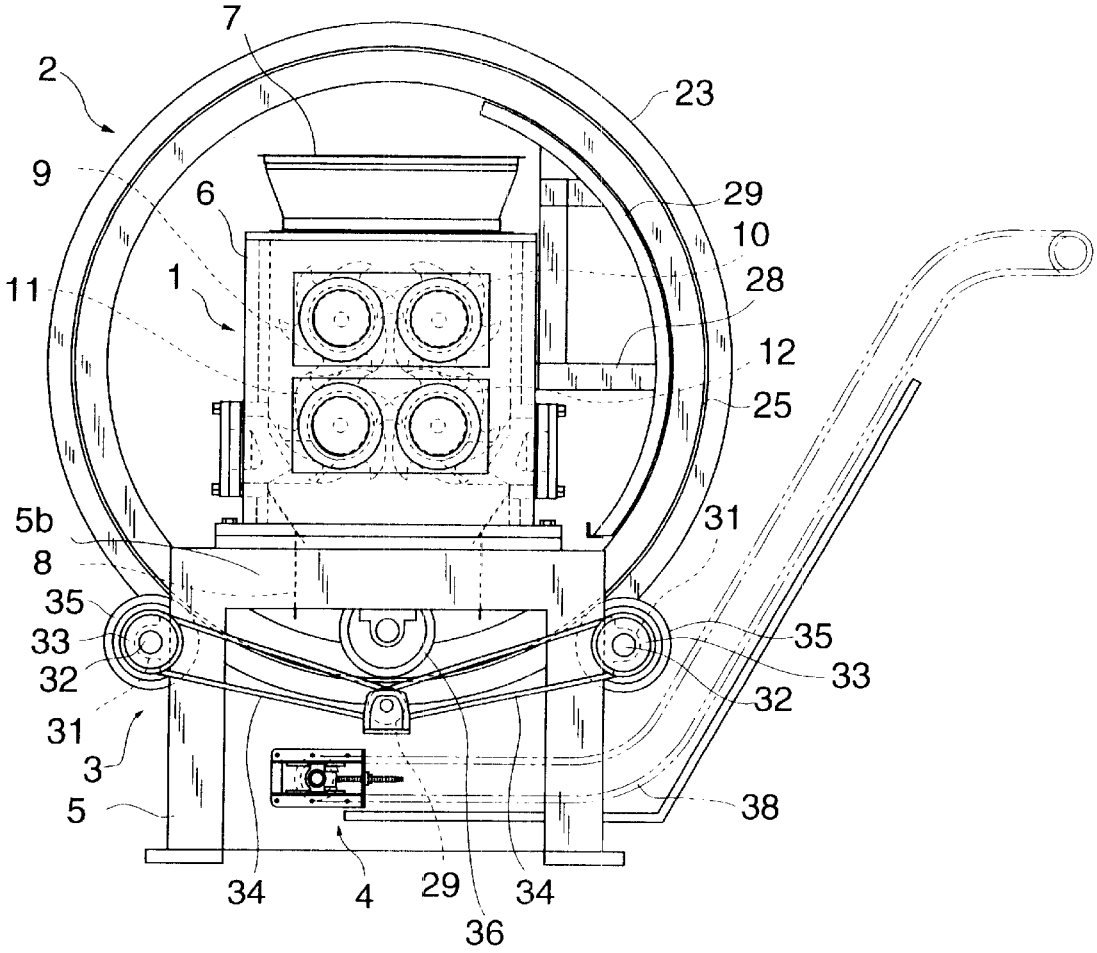
FIG. 5 is a partly cutaway side view of the apparatus according to this invention in operation.
Figure 6:
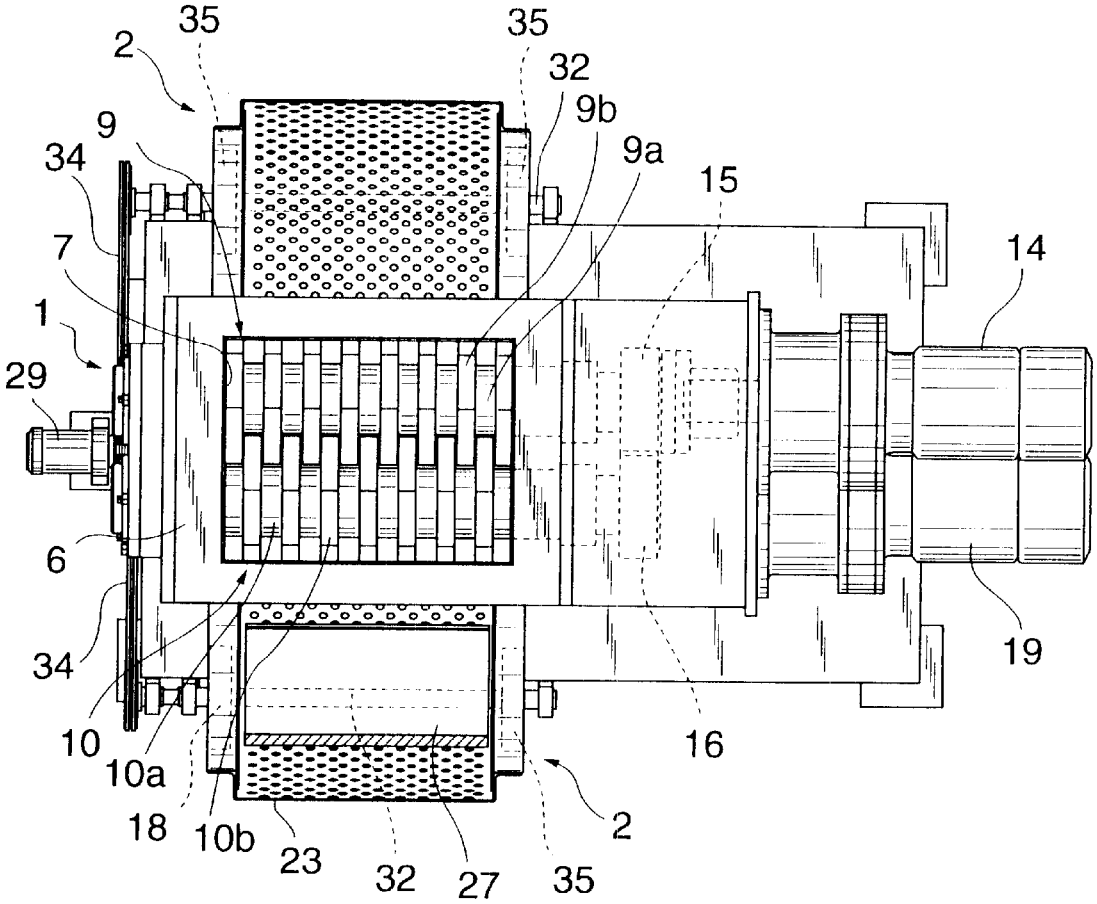
FIG. 6 is a partly cutaway plan view of the apparatus according to this invention in operation.

The shredding device 1 shown in FIG. 4 through FIG. 6 is generally incorporated in a screening device (rotary screening drum 2 in the attached drawings). The waste tire pieces formed by sheading a waste tire by the shredding device 1 are screened by the rotary screening drum 2 driven by rotation driving means 3, and then, collected by a collection means 4.

One example of the shredding device 1 according to the invention is illustrated in FIG. 4 through FIG. 17.

The illustrated shredding device 1 serves to shred the waste tire piece into chips and extract wires from the shredded chips. The shredding device 1 in the screening drum 2 is fixed on a base pedestal 5 as shown in FIGS. 4 to 6. A main body casing 6 of the shredding device 1 is provided in its upper portion with a waste inlet opening 7 and in its lower portion with an outlet opening 8. Within the main body casing 6, there is a shredding section forming the main body of the shredding device. The shredding section includes a first set of paired upper rotary shredding cutters 9 and 10 and a second set of paired lower rotary shredding cutters 11 and 12 arranged one above another between the inlet opening 7 and the outlet opening 8, as shown in FIGS. 4 to 8. The paired upper rotary shredding cutters 9 and 10 are provided with rotating shafts 9*a* and 10*a* rotatably supported by the main body casing 6, and shredding blades 9*b* and 10*b* supported by the rotating shafts 9*a* and 10*a* with intervals formed by collars 9*c* and 10*c* (FIG. 7) in the axial direction of the respective rotating shafts.

The relation between the first set of rotary shredding cutters 9 and 10, which constitutes the first shredding member, and the second set of rotary shredding cutters 11 and 12, which constitutes the second shredding member, will be explained hereinafter.

Figure 9:
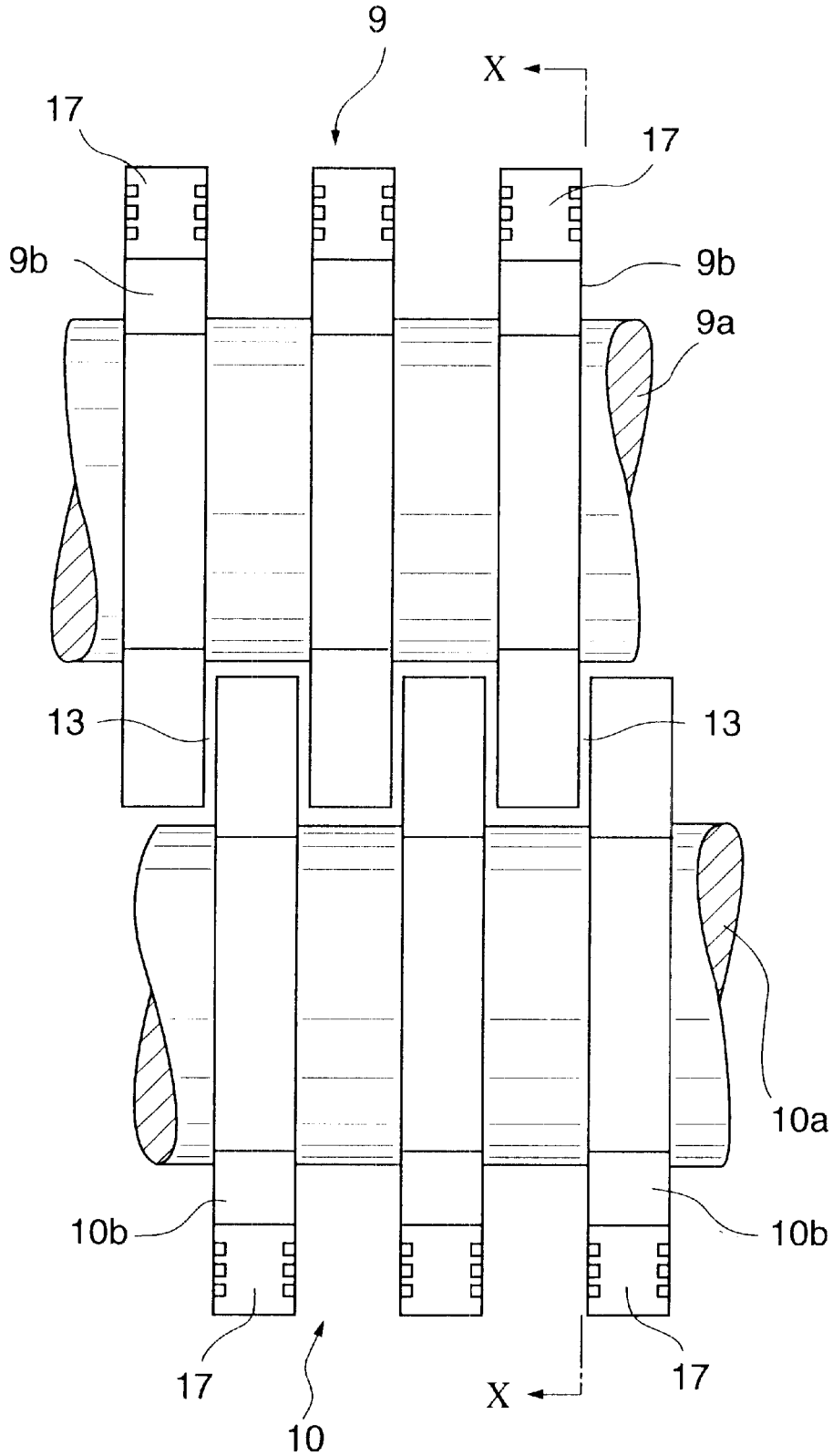
FIG. 9 is a partly enlarged plan view showing the relation between the paired rotary shredding cutters on the upper side of the apparatus of this invention.
Figure 17:
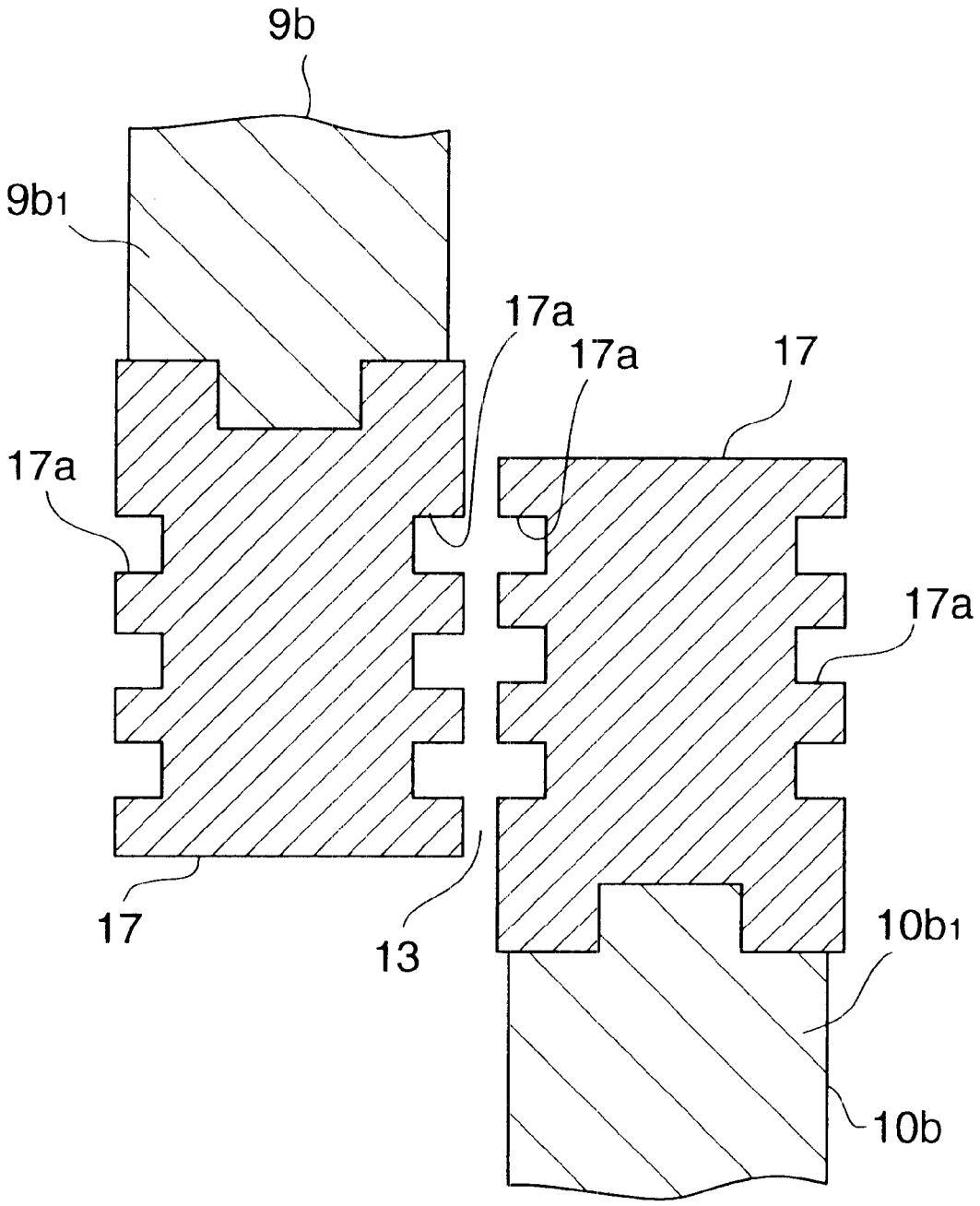
FIG. 17 is an enlarged sectional view explanatory of the state in which blade elements of the respective shredding blades of the paired rotary shredding cutters on the upper side are meshed.

The rotary shredding cutters of the first set are displaced by a little over one tooth width of the cutter relative to those of the second set in the axial direction of the respective rotating shafts 9*a* and 10*a*. The blade elements 9*b*1 and 10*b*1 of paired shredding blades 9*b* and 10*b* are meshed with each other with rotation of the rotary shredding cutters 9 and 10 (FIG. 6). As shown in FIG. 9, between the blade element 9*b*1 of the shredding blade 9*b* and the blade element 10*b*1 of the shredding blade 10*b* in the meshed state, there is formed a space 13 for accommodating the waste tire piece (FIG. 17). The width of the space 13 can be adjusted according to the size of the waste tire piece to be dealt with.

Between the respective shredding blades 9*b*, there is fixed a scraper (not shown), and also, between the respective adjacent shredding blades 10*b*, there is fixed another scraper.

The paired upper rotary shredding cutters 9 and 10 are moved by operating a motor 14 in the respective directions (opposite directions) in which teeth of the cutters bite the waste tire piece placed in the space formed between the shredding blades 9*b* and 10*b*. That is, the rotating shaft 14*a* of the motor 14 is in alignment with the rotating shaft 9*a* of the rotary shredding cutter 9 (FIGS. 4 and 6). Thus, the rotational motion of the motor 14 is transmitted directly to the rotary shredding cutter 9 through the rotating shaft 9*a*. A rotary wheel 15 is fitted on the rotating shaft 14*a* as shown in FIG. 6 and engaged with a transmission wheel 16 fitted on the rotating shaft 10*a* of the other rotary shredding cutter 10, so that the rotational motion of the motor 14 is transmitted to the other rotary shredding cutter 10 through the rotary wheel 15, transmission wheel 16 and the rotating shaft 10*a*.

Figure 10:
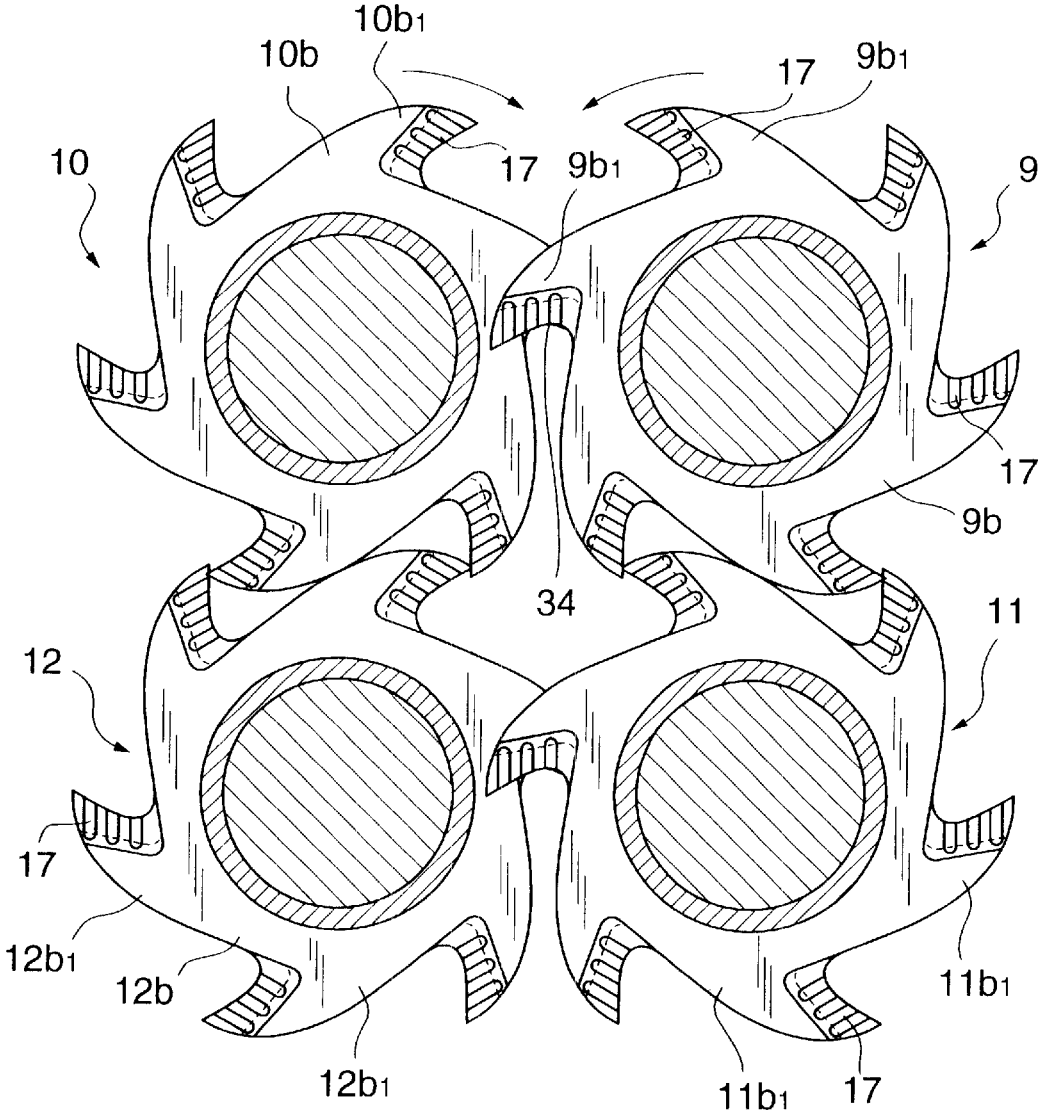
FIG. 10 is a cross section taken on line X—X in FIG. 9, shown in a reduced scale compared with FIG. 9.
Figure 11:
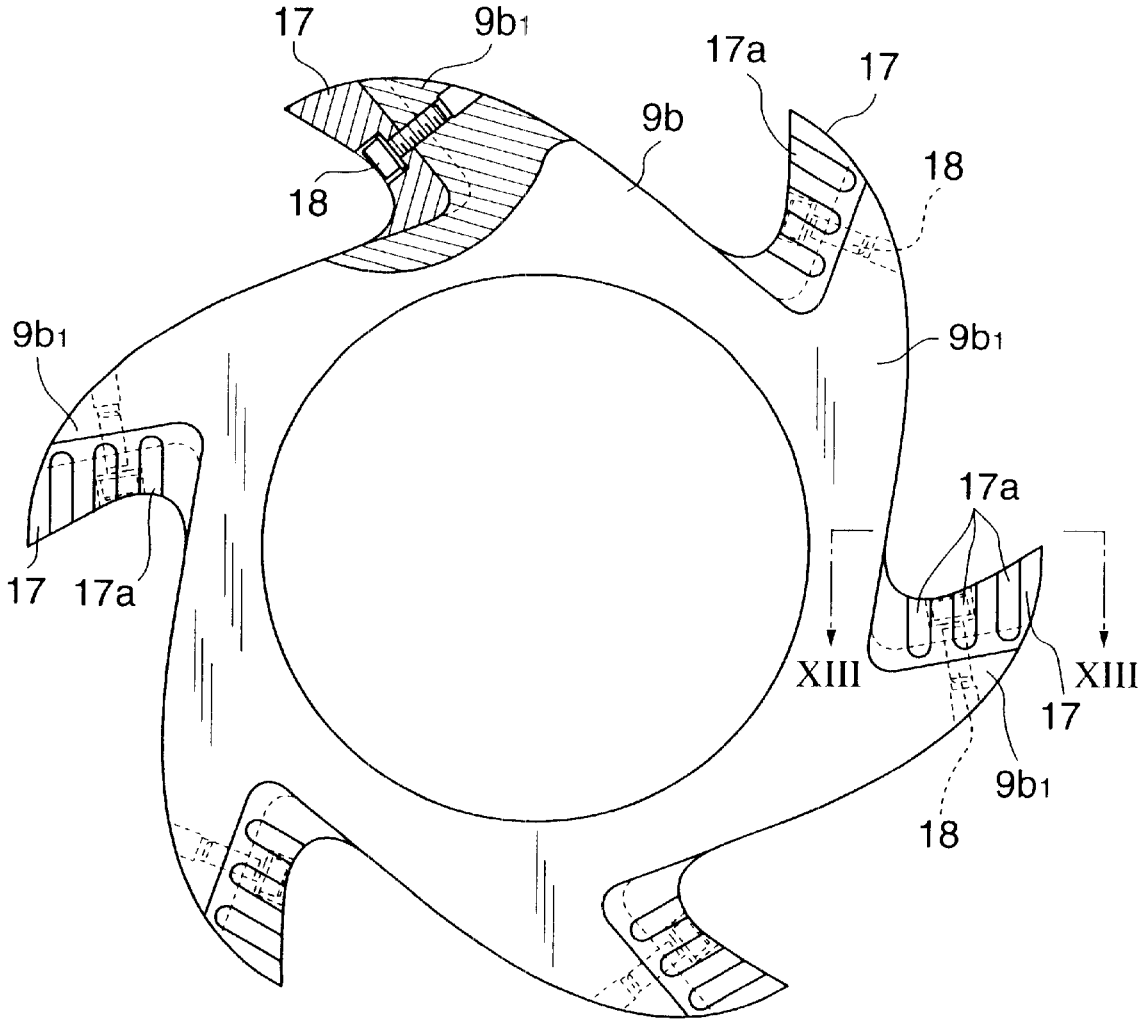
FIG. 11 is a partly cutaway, enlarged side view showing the shredding blade of one rotary shredding cutter placed on the upper side of the apparatus of the invention.

The blade elements 9*b*1 and 10*b*1 of the shredding blades 9*b* and 10*b* in the device of FIG. 9 through FIG. 11 are provided with detachable replacement blades 17. Namely, the blade elements 9*b*1 and 10*b*1 in this embodiment are formed by the replacement blades 17. The structure of the replacement blade 17 and the state in which the replacement blade 17 is mounted will be explained with reference to FIG. 10 through FIG. 17.

Figure 15:
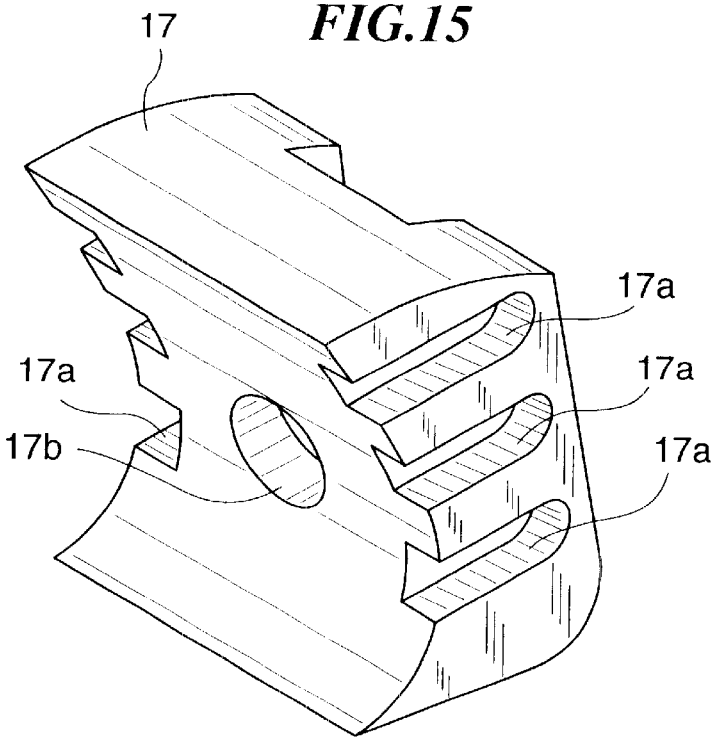
FIG. 15 is an enlarged perspective view showing a replacement blade.
Figure 16:
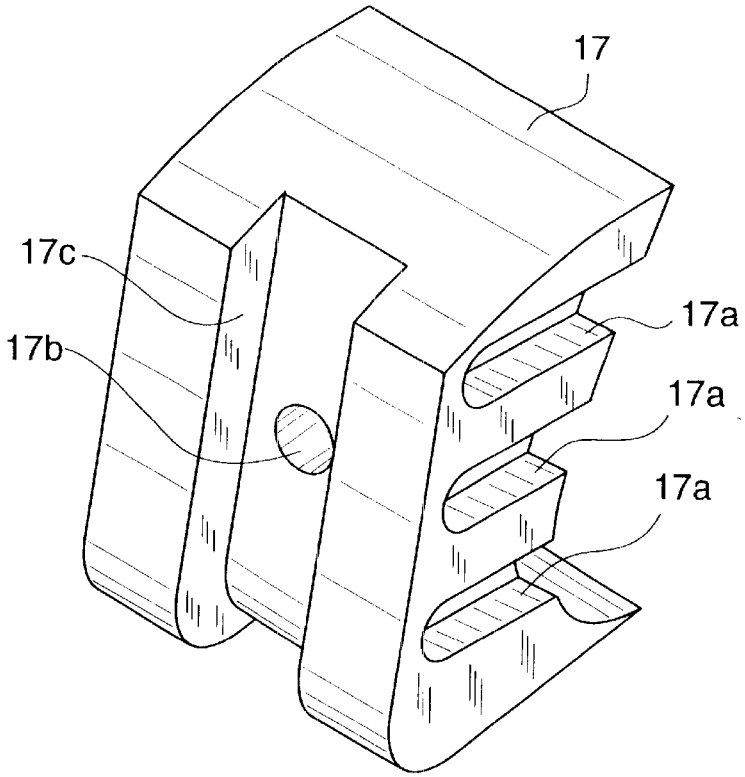
FIG. 16 is an enlarged perspective view showing the rear of the replacement blade.

The replacement blade 17 shown in FIGS. 15 and 16 is provided in each side face thereof with one or more grooves 17*a* (three grooves in one side surface in the embodiment of FIG. 15). Each groove 17*a* has end opening in its front end face and side face confronting the space 13. Namely, each end opening of the replacement blade 17 is open toward the rotating direction of the shredding blade 9*b*, which is shown by the arrow in FIG. 10, and closed at the other end face, so that the groove 17*a* is formed like a cup opening toward the rotational direction of the shredding blade when viewed from side. This is the same with the shredding blade 10*b*. When the blade elements 9*b*1 and 10*b*1 of the shredding blades 9*b* and 10*b* are engaged as shown in FIG. 10 and FIG. 17, the opening of each of the grooves 17*a* is directed downward (FIG. 10).

Figure 12:
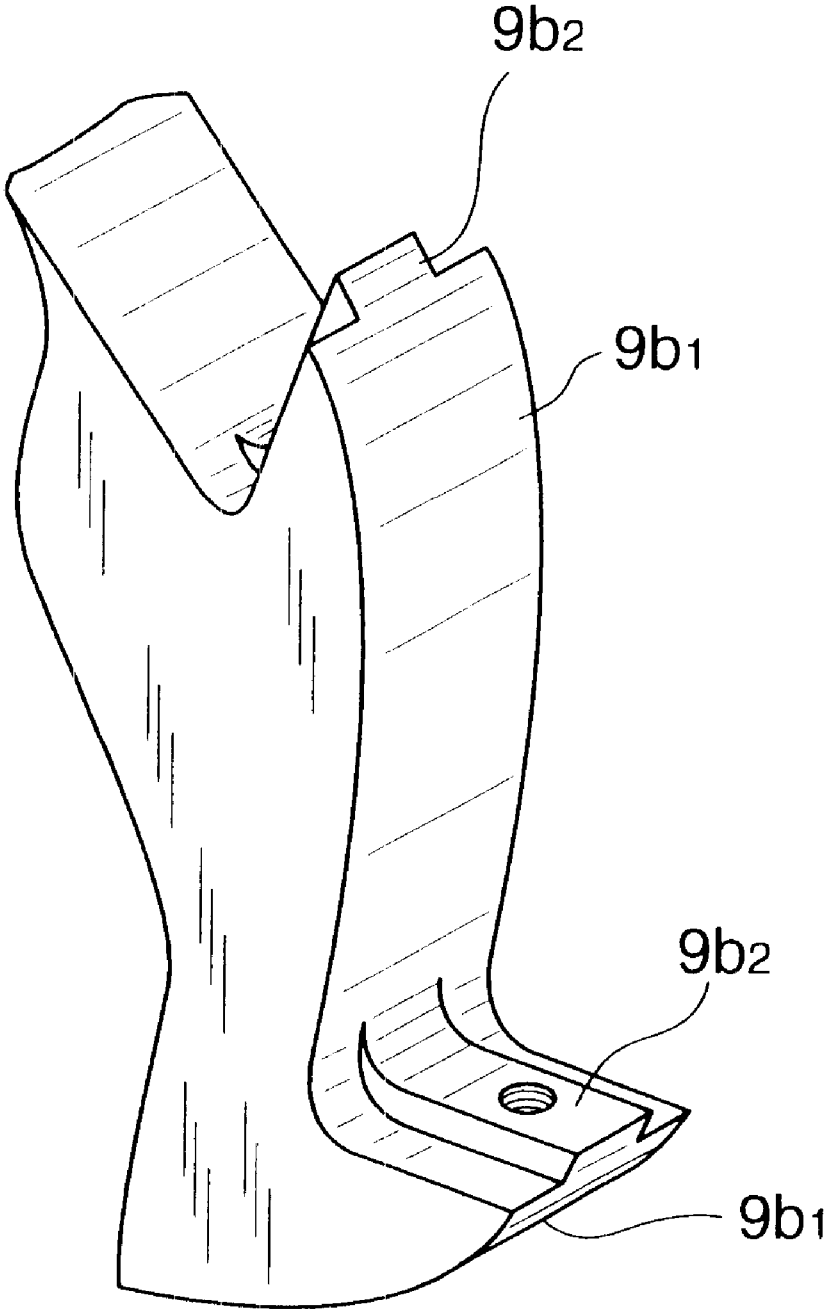
FIG. 12 is an enlarged perspective view showing a part of shredding blade of one rotary shredding cutter placed on the upper side of the apparatus of the invention.
Figure 13:
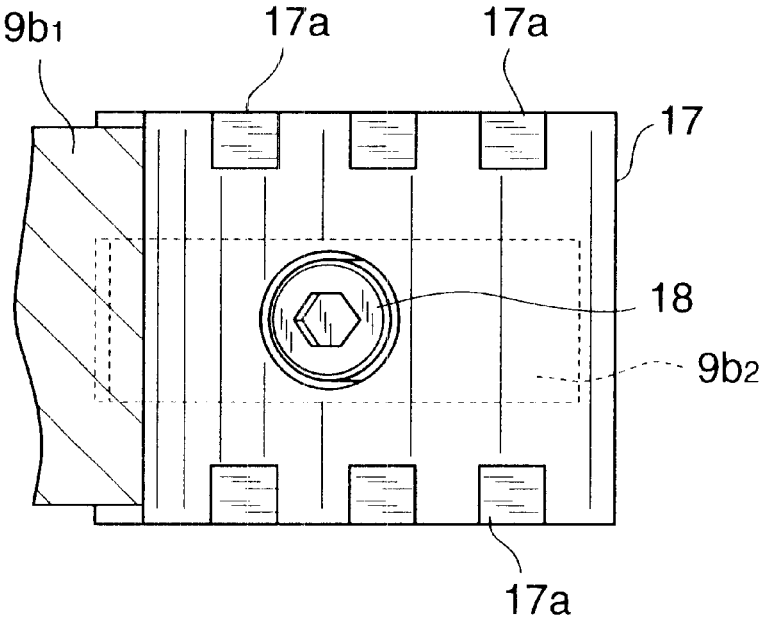
FIG. 13 is an enlarged cross section taken on XIII—XIII in FIG. 11.
Figure 14:
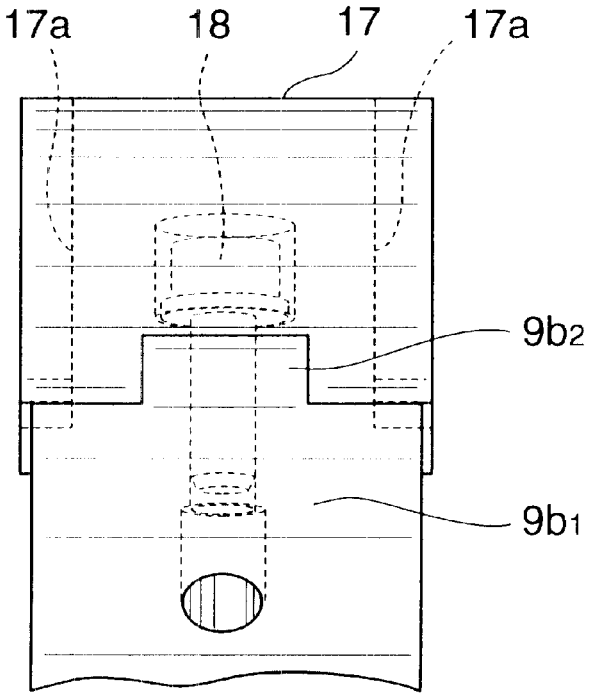
FIG. 14 is a right-side view of FIG. 13.

The replacement blade 17 has a bolt fitting hole 17*b* in the central portion thereof and a holding slot 17*c* extending vertically in the rear surface thereof The blade element 9*b*1 has a rib 9*b*2 as shown in FIG. 12, which is fitted into the holding slot 17*c* of the replacement blade 17 in the assembled state of the shredding blade as shown in FIGS. 11 to 14. The replacement blade 17 is fixedly united with the blade element 9*b*1 by a fixing bolt 18 inserted through the bolt fitting hole 17*b*.

By detaching the fixing bolt 18, the replacement blade 17 can be separated from the blade element 9*b*1.

A plurality of replacement blades 17 (six replacement blades in FIG. 11) is secured to the circumference of the shredding blade 9*b* with the fixing bolts 18 and arranged at regular intervals in the circumferential direction. When the replacement blade 17 incurs damage, it can be replaced with another.

The same replacement blades 17 are also attached to the blade elements 10*b*1 of shredding blade 10*b* of the rotary shredding cutter 10 in much the same way as the foregoing rotary shredding cutter 9, as shown in FIG. 10.

As shown in FIGS. 9, 10 and 17, when the waste tire piece is introduced into the space between the shredding blades 9*b* and 10*b* in their meshed state, i.e. adjacent to each other as shown in FIG. 9, the waste tire piece is forcibly torn into chips, and simultaneously, if the waste tire piece contains a wire, the wire is extracted from rubber components of the tire piece. The extraction of the wire from the rubber components is effectively carried out by the shredding blades 9*b* and 10*b* with the cooperation of the space 13 between the blade elements 9*b*1 and 10*b*1 and grooves 17*a* formed in the shredding blades 9*b* and 10*b*.

The functions of the space 13 between the respective blade elements 9*b*1 and 10*b*1 and grooves 17*a* formed in the shredding blades 9*b* and 10*b* will be described in detail later.

Figure 7:
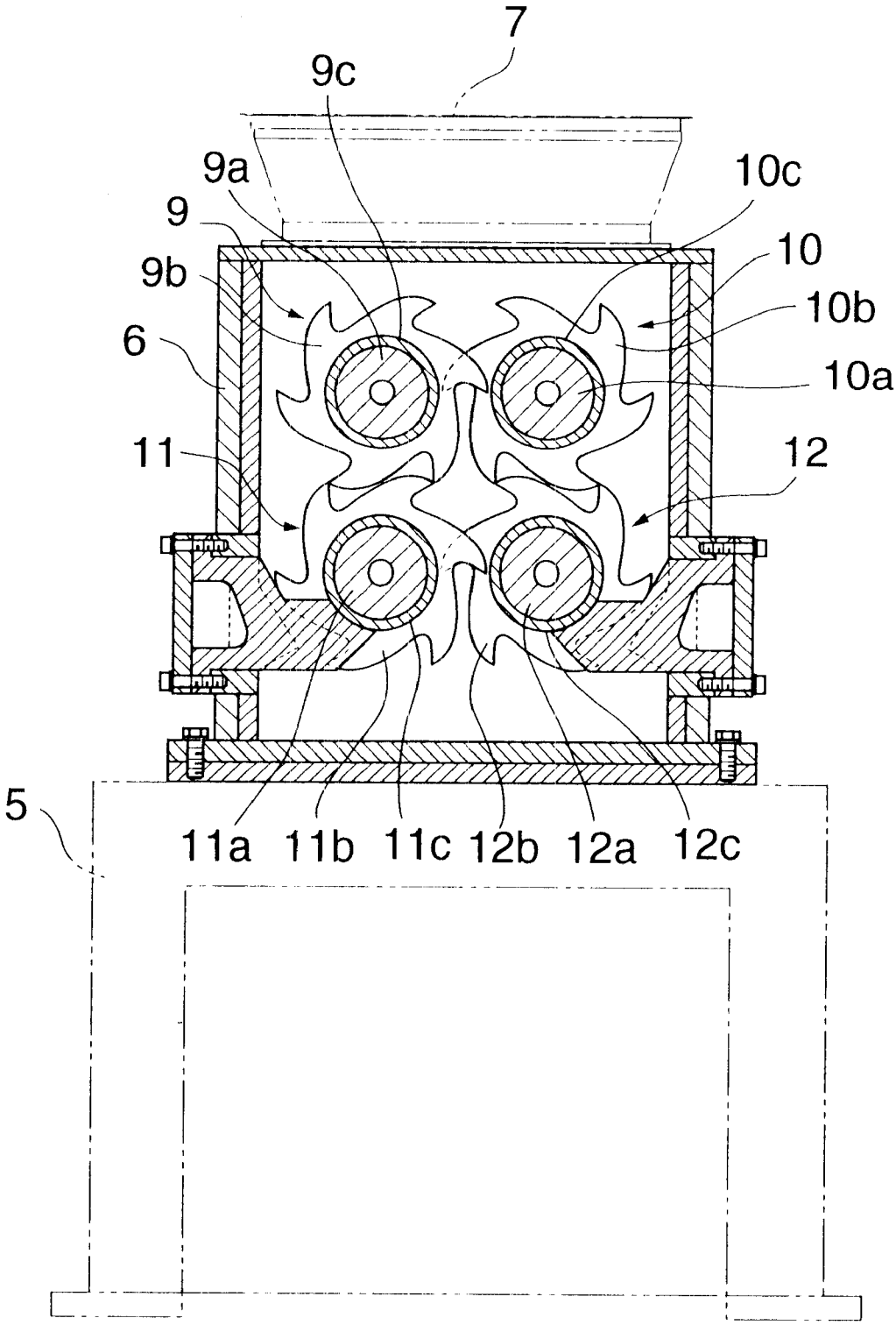
FIG. 7 is a sectional view showing the relation between the paired rotary shredding cutters on both upper and lower sides in the main body casing of the apparatus of this invention.
Figure 8:
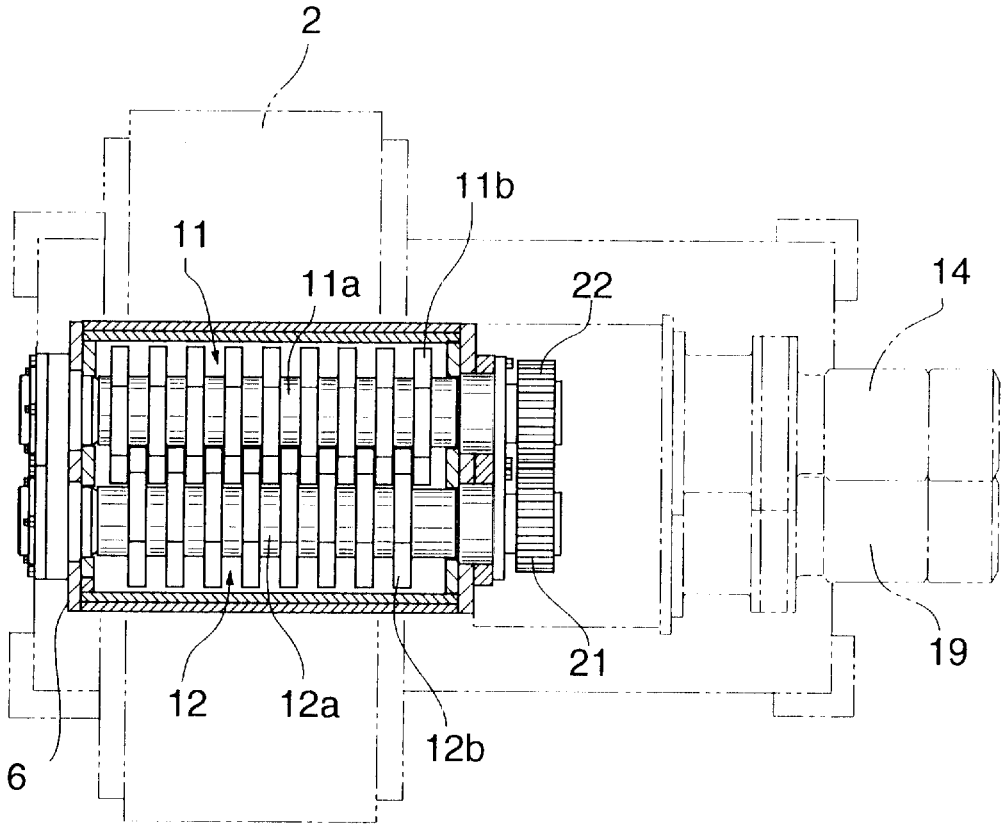
FIG. 8 is a plan view showing the relation between the paired rotary shredding cutters on the lower side of the apparatus of this invention.

Also, as shown in FIG. 7 and FIG. 8, the structure and function of the lower rotary shredding cutters 11 and 12 in the first and second shredding members have analogous structures and functions to those of the upper rotary shredding cutters 9 and 10 and will not be described in detail again.

In FIGS. 10, 11*b*1 and 12*b*1 denote blade elements formed on the shredding blades 11*b* and 12*b*. To each of the blade elements 11*b*1 and 12*b*1, a replacement blade 17 is attached.

As shown in FIGS. 4, 6 and 8, the rotational motion of a motor 19 is transmitted to one of rotary shredding cutters, 12, via a rotary wheel 20 fitted on a rotating shaft 19*a* and a transmission wheel 21 on a rotating shaft 12*a*. The rotational motion of the motor 19 is further transmitted to the other rotary shredding cutter 11 via the rotary wheel 20, transmission wheel 21 and a transmission wheel 22 on a rotating shaft 11*a*.

The rotary screening drum 2 serving as the screening device will be explained hereinafter with reference to FIGS. 4–6 and FIGS. 18 to 23.

The rotary screening drum 2 has a function of sorting out waste tire pieces of less than the predetermined size from shredded pieces.

A drum body 23 of the rotary screening drum 2 is formed in the shape of a channel as shown in FIGS. 18 to 21, and has a cylindrical wall with screening perforations 24. There are guide members 25 formed along the outer peripheral sides of the drum body 23.

Figure 20:
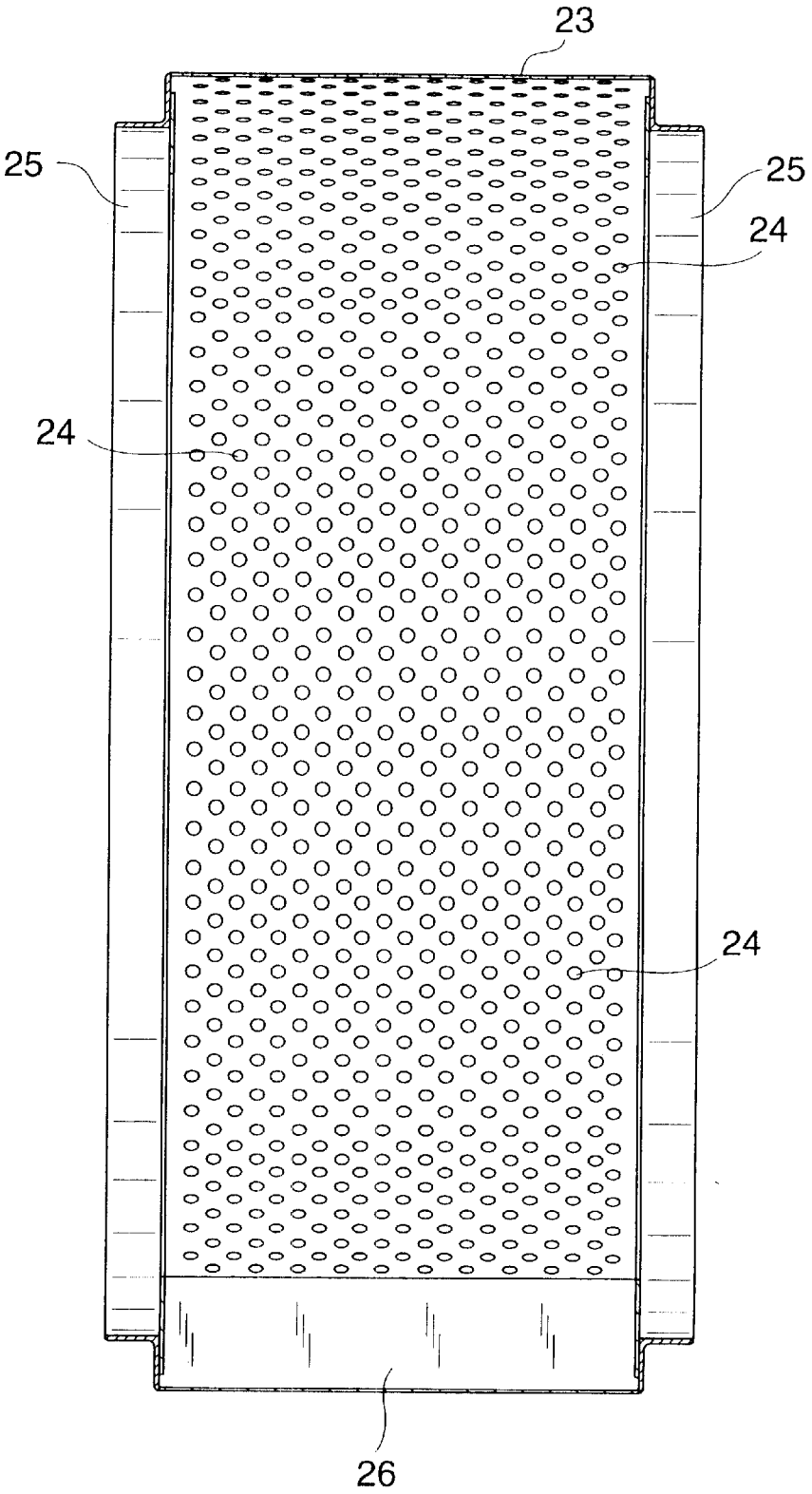
FIG. 20 is an enlarged view showing the rotary screening drum excluding a wall panel from that shown in FIG. 19.

The drum body 23 shown in FIG. 20 is formed of a perforated plate. Each screening perforation 24 in the drum body is as large in diameter as required for the purpose, so that only the waste tire pieces of less than the predetermined size are permitted to pass the drum body 23 downward and be discharged out of the drum body.

The drum body 23 is provided with a partition panel 26 extending in the radial direction of the drum body. With the partition panel 26, the drum body 23 is divided into two circumferential parts. It is sufficient to mount the partition panel 26 on only one portion inside the drum body 23 as illustrated in FIG. 18 and FIG. 19, but a plurality of partition panels may of course be mounted on suitable portions inside the drum body to divide the drum body into some circumferential parts.

Figure 18:
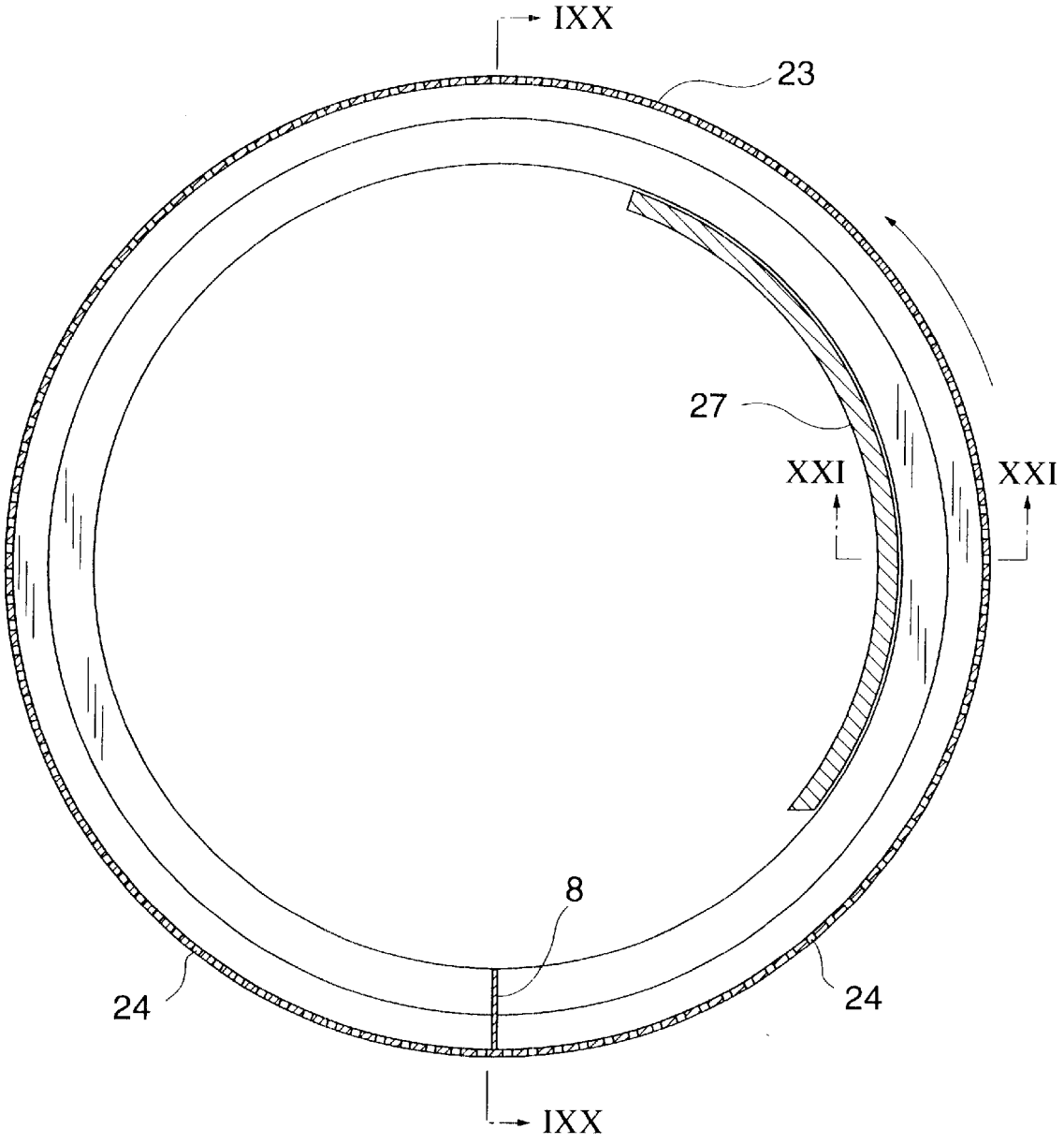
FIG. 18 is an enlarged sectional view of a rotary screening drum in the apparatus of the invention.
Figure 19:
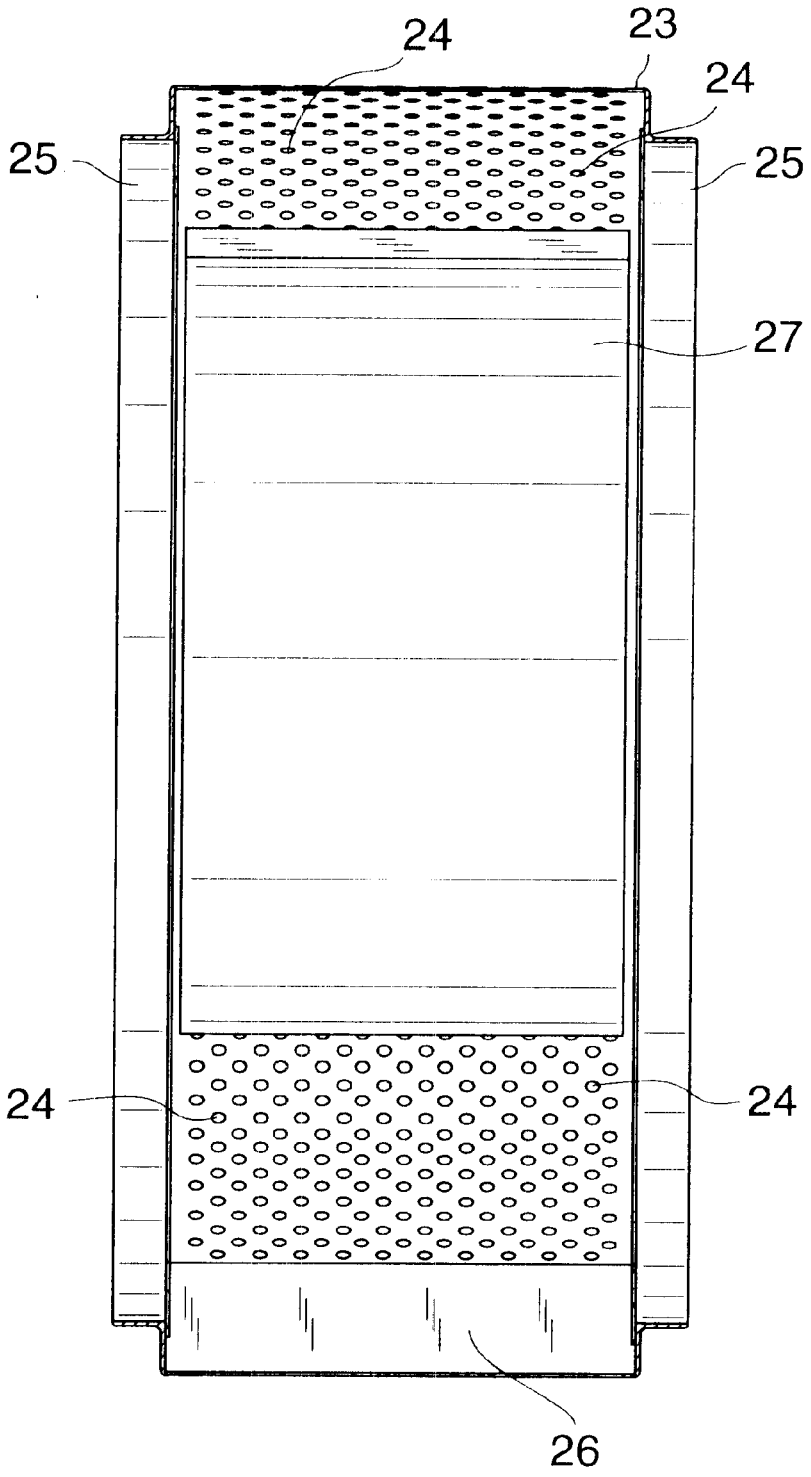
FIG. 19 is an enlarged cross section taken on IXX—IXX in FIG. 18.
Figure 21:
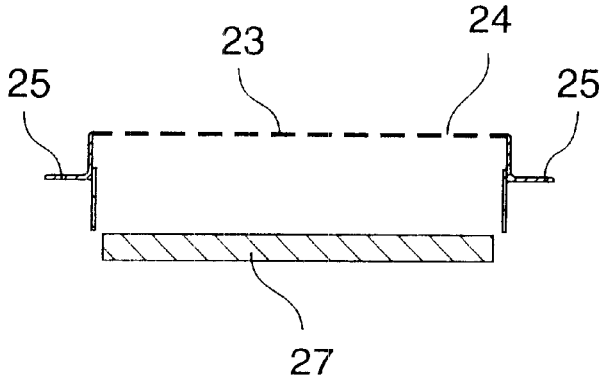
FIG. 21 is an end view taken on line XXI—XXI in FIG. 18, shown in a reduced scale compared with FIG. 18.

Inside the drum body 23, an arc-shaped wall panel 27 is mounted apart from and along the inner circumferential surface of the drum body as shown in FIGS. 18, 19 and 21. The wall panel 27 is supported by a support frame 28 connected to the side portion of the main body casing 6 of the shredding device 1 (see FIG. 5). The wall panel 27 extends upward from the lower portion of the drum body 23 in the rotational direction of the drum (direction of the arrow in FIG. 18). The wall panel 27 has a function of preventing shredded chips of the waste tire pieces, which are not allowed to pass the drum body 23 through the screening perforations 24 and left inside the drum body, from falling into the center portion of the drum body.

The rotation driving means 3 will be explained hereinbelow with reference to FIGS. 4, 5, 22 and 23.

A motor 29 for driving the drum body 23 is attached to a side portion 5*a* of the base pedestal 5 through a base, as shown in FIG. 4 and FIG. 5. A belt 34 runs through a rotary wheel 30 on a rotating shaft of the motor 29 and transmission wheels 33 on end portions of rotating shafts 32 placed on both sides in FIG. 5. Each rotating shaft 32 is rotatably supported by bearings 31 secured on the side portion 5*a* of the base pedestal 5.

Figure 22:
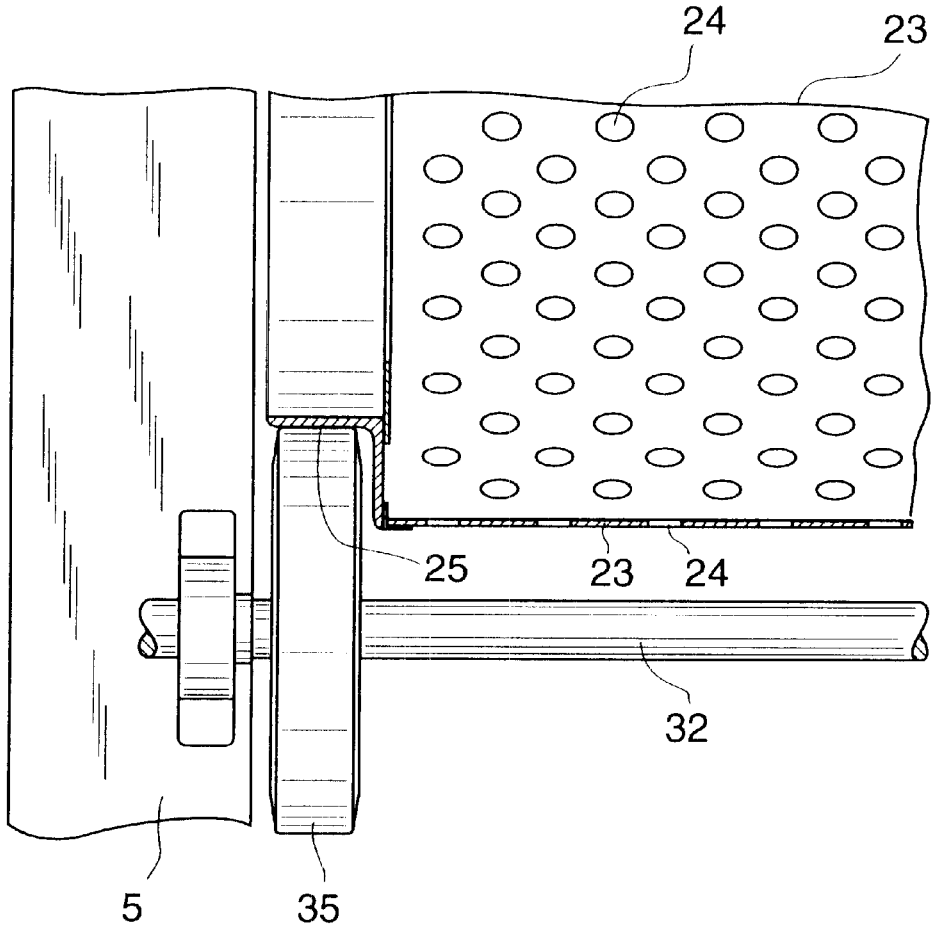
FIG. 22 is an enlarged sectional view showing the relation between the rotary screening drum and a feed wheel in the apparatus of this invention.
Figure 23:
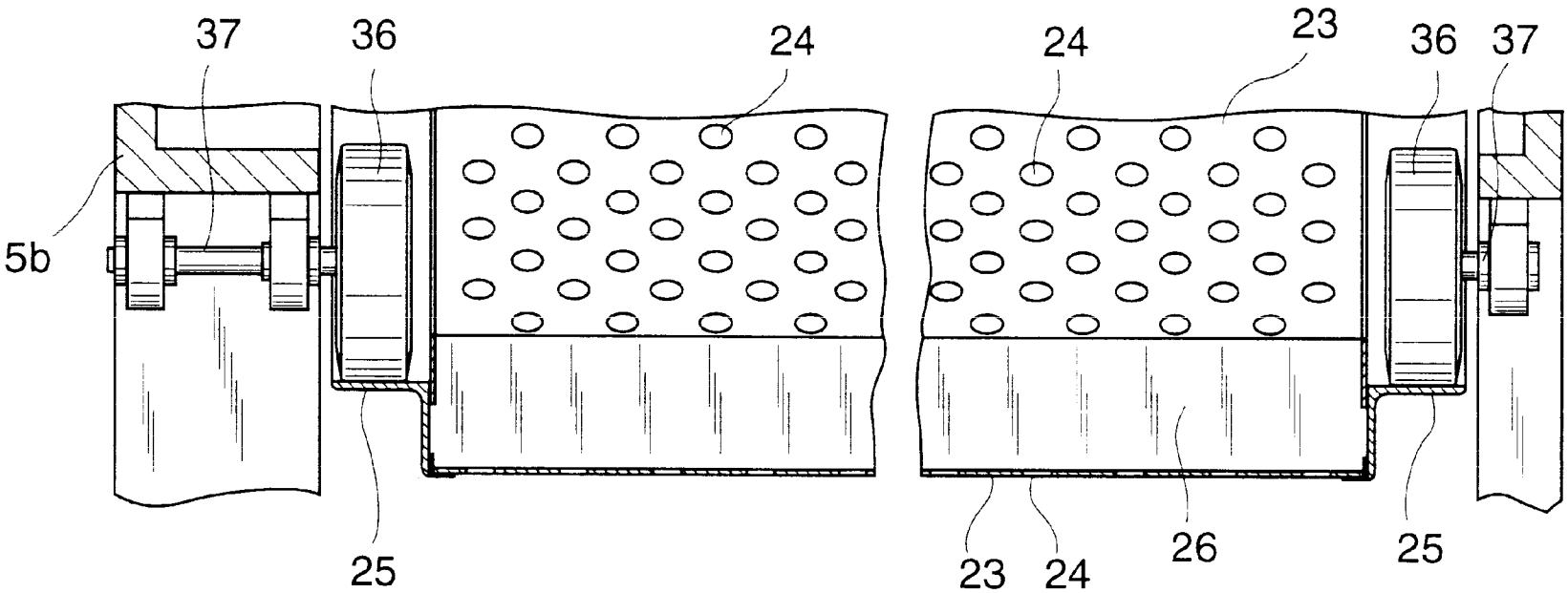
FIG. 23 is an enlarged sectional view showing the relation between the rotary screening drum and pressure wheels in the apparatus of this invention.

Feed wheels 35 are fitted on both side end portions (both side ends in FIG. 6) of the rotating shaft 32. The feed wheels 35 are placed below the both side portions of the rotary screening drum 2 and in contact with the aforenoted guide members 25 (FIG. 22). The feed wheels 35 hold four lower corners of the rotary screening drum 2.

The rotational motion of the motor 29 is transmitted to the feed wheels 35 through the rotary wheel 30, belt 34 and transmission wheels 33. Consequently, the rotary screening drum 2 is rotated in the direction indicated by the arrow in FIG. 18 (counterclockwise direction in FIG. 5) with rotation of the feed rollers 35 which come in contact with the guide members 25.

As shown in FIG. 4 and FIG. 5, each of pressure wheels 36 is mounted inside the guide member 25 on the lower center portion of the rotary screening drum 2. The pressure wheel 36 is in contact with the inner surface of the guide member 25 to prevent the screening drum 2 from rocking or vibrating. Each pressure wheel 36 is fitted on a rotating shaft 37 rotatably supported on the upper portion 5b of the base pedestal 5, so that the screening drum 2 can stably rotate due to the pressure wheels 36.

The relation between the shredding device 1 and the rotary screening drum 2 will be described hereinbelow.

As shown in FIG. 4 and FIG. 5, the inner portions of the drum body 23 of the screening drum 2 are opposed to each other just above the inlet opening 7 of the body casing 6 and just below the outlet opening 8 of the body casing 6, so as to permit the waste tire piece (shredded chip) carried to the portion just above the inlet opening 7 to fall into the inlet opening 7 and the chips into which the waste tire piece is shredded by the shredding device 1 to be sent out onto the drum body 23 through the outlet opening 8.

Next, the collection means 4 will be explained.

The collection means 4 shown in FIG. 4 and FIG. 5 is chiefly formed of a conveyor 38.

Figure 24:
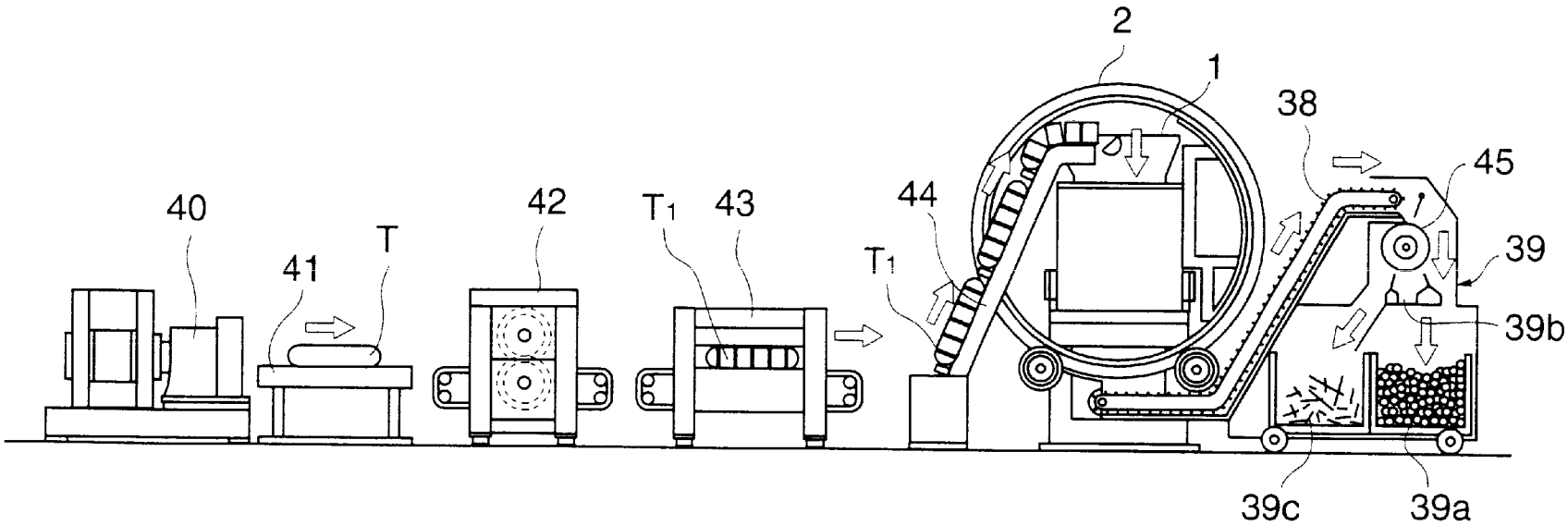
FIG. 24 is a front view showing an operation line for disposing of a waste tire according to this invention.

By the conveyor 38, the shredded chips discharged through the screening perforations 24 formed in the screening drum 2 are carried to an accumulation section 39 (FIG. 24). The conveyor is used as a transport means for shredded chips in this embodiment, but may of course be of any type, e.g. a carrier container.

Thus, when the waste tire pieces cut into a predetermined size are thrown in the shredding device 1 through the inlet opening 7 as shown in FIG. 7, the waste tire pieces are first shredded by the upper rotary shredding cutters 9 and 10, and then, further shredded by the lower rotary shredding cutters 11 and 12 into fine chips. As the waste tire pieces including rubber and wires are shredded, wires embedded in the waste tire pieces are extracted from the rubber components, and then, fall into the lower rotary shredding cutters 11 and 12 along with the rubber components. The shredded chips and wires are further shredded by the lower rotary shredding cutters 11 and 12, to completely sort out the wires from the rubber component chips. Consequently, finely shredded chips resultantly obtained, which include shredded rubber components and wires, fall onto the inside of the drum body 23 of the screening drum 2 through the outlet port 8.

Only the shredded chips of less than the predetermined size fall onto the conveyor 38 of the collection means 4 through the screening perforations 24 of the drum body 23, and then, are conveyed to the accumulation section 39 by the conveyor 38 (FIG. 24). Also, the wires passing through the screening perforations 24 are sent to the accumulation section 39 by the conveyor 38.

The chips formed of rubber-only components, components with wires and wires, which are not allowed to pass through the screening perforations 24 of the drum body 23, are again sent to the upper portion of the rotating drum 2 and fall into the shredding device 1 through the inlet opening 7 to be reprocessed.

The primary shredding process using the upper rotary shredding cutters 9 and 10, the secondary shredding process using the lower rotary shredding cutters 11 and 12, and the tertiary shredding process for re-shredding the waste matter will be explained hereinafter.

Figure 2A:
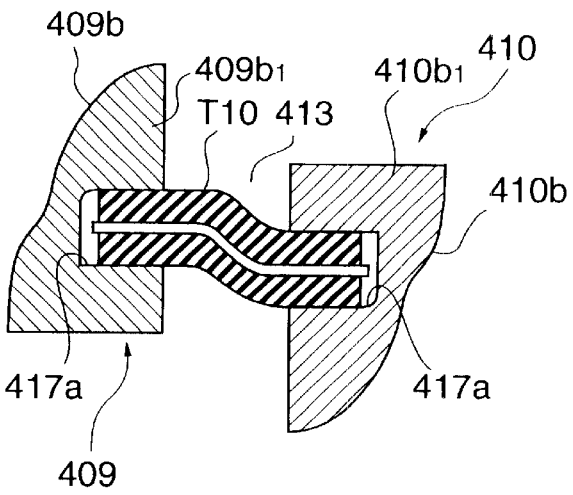
FIGS. 2A and 2B are cross-sectional views showing a process of shredding a waste matter into pieces in a second embodiment of the method according to this invention.
Figure 2B:
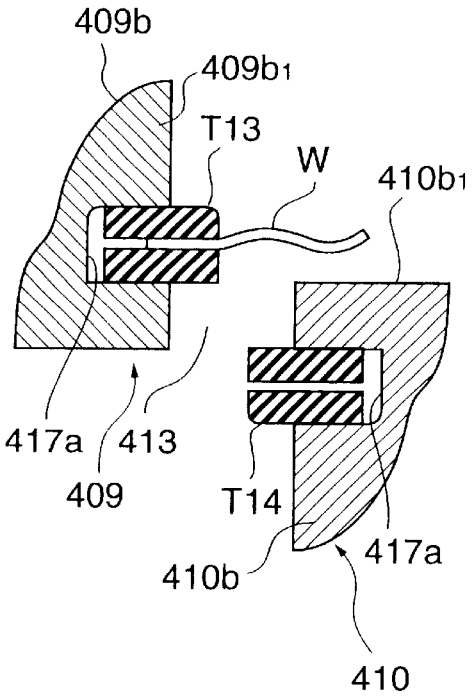

The first rotary shredding cutter 9 and 11, shredding blades 9*b* and 11*b*, blade elements 9*b*1 and 11*b*1, second rotary shredding cutters 10 and 12, shredding blades 10*b* and 12*b*, blade elements 10*b*1 and 12*b*1, space 13 and grooves 17*a* in this embodiment illustrated correspond respectively to the first rotary shredding cutters 409, shredding blades 409*b*, blade elements 409*b*1, second rotary shredding cutters 410, shredding blades 410*b*, blade elements 410*b*1, space 413 and grooves 417*a* in the embodiment shown in FIG. 1 to FIG. 3. Accordingly, the explanation of the aforementioned processes will be made with reference to not only FIG. 10, but also FIGS. 1A, 1B, 2A, 2B, 3A and 3B.

[Primary shredding process using the cutters 9 and 10]

The waste tire piece or pieces (waste tire piece T10 in FIG. 1A) entirely or partially enter into the space 13 (space 413 in FIG. 1A) formed between the blade elements 9*b*1 and 10*b*1 (blade elements 409*b*1 and 410*b*1) and shredded by the blade elements 9*b*1 and 10*b*1. In shredding, the waste tire piece is shredded as torn off in opposite directions, rather than cut straight, owing to the space 13 defined between the blade elements 9*b*1 and 10*b*1, consequently to obtain shredded chips of the waste tire (chips T11 and T12 in FIG. 1A). That is to say, the waste tire piece is shredded with the cooperation of the blade elements 9*b*1 and 10*b*1. In shredding the waste tire piece, shearing forces acting in opposite directions are exerted to the cut surface portion in the waste tire piece, so that the waste tire piece including the wire is torn off and then sorted out into rubber components and the wire. In the process of tearing off the waste tire piece, the piece is partially caught by the grooves 17*a* (space 417*a* in FIG. 1A) formed in the replacement blades 17 adjacent to each other as shown in FIG. 17, so as to be effectively torn off by the replacement blades 17 moving in opposite directions. As the waste tire piece is torn off by being drawn by the replacement blades 17 moving in opposite directions while being firmly caught by the grooves in the replacement blades, the wire closely joined to the rubber component of the tire is easily be separated from the rubber component (see FIG. 1B).

When the waste tire piece in the space 13 assumes the same posture as the waste tire piece T10 shown in FIG. 2A, the waste tire piece is divided into a rubber chip with wire (chip T13 in FIG. 2B) and a rubber-only chip (chip T14 in FIG. 2B).

[Secondary shredding process using cutters 11 and 12]

The shredded chips and wire (chips T11 and T12 and wire W in FIG. 1B) into which the waste tire piece is torn in the space 13 by the upper blade elements 9*b*1 and 10*b*1 are then introduced into the space 13 (space 413 in FIG. 1A) between the blade elements 11*b*1 and 12*b*1 (blade elements 409*b*1 and 410*b*1 in FIG. 1A), consequently to be shredded into finer chips by movements of the blade elements in opposite directions.

Even when the waste tire piece is divided into the rubber chip with wire (chip 15 in the embodiment of FIG. 3A) and the rubber-only part (chip 16 in FIG. 3A) by the upper blade elements 9*b*1 and 10*b*1, the wire closely joined to the rubber part is effectively extracted and separated from the rubber part owing to the grooves (grooves 17*a* in FIG. 3A) (see FIG. 3B).

[Tertiary shredding process for re-shredding shredded chips]

The shredded chips (rubber-only chips, and chips with wires), which are obtained by subjecting the waste tire piece to the secondary shredding process, but too large in diameter to pass the screening perforations 24 of the rotary drum 2, are re-sent to the upper portion of the rotary drum 2 and then introduced into the shredding section through the inlet opening. The shredded chips again introduced into the rotary drum 2 are again reprocessed in the same manner as the first and second shredding processes. By effecting this reprocess, most shredded chips and wires are further shredded into chips of a size smaller than the screening perforation, thus to facilitate extraction of the wires from the rubber parts of the waste tire pieces.

As a result, the shredded chips to be reprocessed are dealt with together with another waste tire piece to be newly subjected to the primary shredding process by the upper blade elements 9*b*1 and 10*b*1. Likewise, a mixture of the shredded chips to be reprocessed and the waste tire pieces once shredded by the upper blade elements 9*b*1 and 10*b*1 are shredded by the lower blade elements 11*b*1 and 12*b*1.

Since each groove 17*a* formed in between the respective blade elements is open at one end toward the rotating direction of the shredding blade and closed at the other end so as to be formed like a cup as shown in FIG. 15, the waste tire piece is caught by the grooves 17*a*, so that the parts of the waste tire piece are bitten and firmly held by the grooves 17*a* in the compressed state in the shredding processes. As a result, the waste matter to be dealt with in the space 13 are firmly seized on both sides and torn off in opposite directions, thus being assuredly shredded into chips.

Besides, since the shredding processes can be continuously repeated, shredded chips of a desired size, which conform to the prescribed screening standard, can be mass produced swiftly with high efficiency.

The operation of disposing of a waste tire will be explained in detail hereinafter.

First, the processes of shredding the waste tire piece and screening and collecting shredded pieces by use of a waste tire disposal line as shown in FIG. 24, which comprises the shredding device 1 and screening device 2, will be described.

[1] Preliminary Treatment

A waste tire T is subjected to the following preliminary treatment prior to the shredding process.

In the embodiment shown in FIG. 24, the waste tire T is first subjected to wire extraction by use of a bead-wire extracting device 40. Bead wires are extracted from the waste tire in this process, but a narrow belt wire cannot be removed and is left in the waste tire T.

The waste tire T free from the bead wires is sent to a tire cutting machine 42 by a conveyor 41. The waste tire T is cut into waste tire pieces T1 of an adequate size by the tire cutting machine 42. In a case of disposing of a tire of a passenger car, it is desirable to cut the tire into four, for instance. In a case of a large tire of a truck or the like, it is desirable to cut the tire into six, for instance. That is, the waste matter such as the tire T1 may be cut into pieces of a size easy to shred with the shredding device 1.

The cut pieces into which the waste matter T1 is cut are sent to a heating device 43. The cut pieces T1 are heated by heating means such as a high-frequency heater and electromagnetic induction heater in the heating device 43. By heating the cut pieces T1, it is softened to loosen bonding of the rubber part of the tire and the belt wire embedded in the tire.

The cut pieces T1 thus heated is introduced into the body casing 6 through the inlet opening 7 of the shredding device 1 by use of a conveyor 44.

[2] Shredding

The cut pieces T1 of the waste tire introduced into the shredding device are first shredded by the upper rotary shredding cutters 9 and 10 as shown in FIG. 4 and FIG. 6, so that some wires are simultaneously separated from the rubber parts. The shredded pieces and wires extracted from the waste tire pieces are subsequently shredded by the lower rotary shredding cutters 11 and 12, so that most wires are sorted out from the rubber parts of the waste tire pieces. The shredded pieces and extracted wires fall onto the inside of the drum body 23 of the rotary screening drum 2 through the outlet opening 8.

As regards the shredding and sorting situations, the entire or part cut pieces T1 are squeezed into the space 13 formed between the shredding blades 9*b* and 10*b* of the upper rotary shredding cutters 9 and 10 and torn off by the blade elements 9*b*1 and 10*b*1 moving in opposite directions (upward and downward directions in FIG. 17). During the course of shredding, the waste tire piece is pulled up and down while being firmly caught in part by the grooves 17*a*, and simultaneously, the wires are sorted out from the rubber parts of the waste tire piece.

The waste tire piece is further shredded by the shredding blades 11*b* and 12*b* of the lower rotary shredding cutters 11 and 12. That is, further shredding and sorting of the pieces shredded by the shredding blades 9*b* and 10*b* of the upper rotary shredding cutters 9 and 10 are effected by the blade elements 9*b*1 and 10*b*1.

Even parts, which are left over after shredding by the rotary shredding cutters and connected to the cut piece T1 or shredded pieces, can assuredly be shredded and sorted out by repeatedly passing through the upper rotary shredding cutters 9 and 10 and the lower rotary shredding cutters 11 and 12.

[3] Screening and Re-shredding

Of the shredded pieces and sorted wires, which fall onto the inside of the drum body 23 through the outlet opening 8, ones of a size smaller than the screening perforation formed in the rotary drum 2 are allowed to pass through the screening perforations of the rotary drum and fall onto the conveyor 38. The shredding pieces and wires passing through the screening perforations of the rotary drum 2 are transported to the accumulation section 39 by the conveyor 38.

The remaining pieces and wires, which are not allowed to pass through the screening perforations 24 of the rotary drum 23 and left inside the rotary drum, are sent to the top of the rotary drum with the rotation of the rotary drum rotating in the direction indicated by the arrow in FIG. 18, while being held by the partition panel 26, and there, fall over the wall panel 27 through the inlet opening 7 into the inside of the body casing 6 of the shredding device by their own weight, so as to be shredded once more in the shredding device and sorted out into rubber parts and wires.

The shredded pieces to be reprocessed are dealt with together with cut pieces T1 newly introduced in the shredding device.

Thereafter, shredded chips and wires sent to the inside of the drum body 23 through the outlet opening 8 are sorted out by the screening drum 2, and then, chips and wires passing through the screening perforations 24 are transported to the accumulation section 39 by the conveyor 38.

[4] Collection of Shredded Chips

The shredded chips including wires, which are sent to the accumulation section 39, are sorted out to rubber-only chips, rubber chips with wires, and wire-only chips by a magnetic separator 45 installed next to the outlet end of the conveyor 38 as shown in FIG. 24. The magnetic separator 45 in the illustrated embodiment is of a drum type in which an electromagnet is fixed in a rotating separator drum. With this magnetic separator, the rubber-only chips of the shredded chips sent to the accumulation section are not attracted magnetically by the electromagnet and fall into a first accumulation receptacle 39*a*. The rubber chips with wires and wire-only chips are attracted magnetically and come in magnetic contact to the surface of the drum. As the drum rotates, the magnetic force of the electromagnet, which is influencing the chips with wires and the wire-only chips, is gradually decreased. As a result, the chips with wires first fall into a discharge receptacle 39*b*, and then, the wire-only chips fill into a second accumulation receptacle 39*c*. The chips with wires, which fall into the discharge receptacle 39*b*, are sent back to the inlet opening 7 of the shredding device 1 by operating a conveyor (not shown), and again subjected to shredding and sorting there. The chips with wires are repeatedly processed until the chips are sorted out into rubber-only chips and wire-only chips and become smaller than the prescribed size.

According to the embodiment shown in FIG. 4, the shredding device 1 is arranged inside the rotary screening drum 2, so that the shredded chips and wires discharged from the shredding device 1 through the outlet opening 8 can fall directly into the drum body 23 without using any transporting means for feeding the shredded chips and wires from the shredding device 1 to the rotary screening drum 2. Thus, the shredding and sorting of the waste pieces and so on can be readily performed smoothly.

Even when again shredding the shredded waste pieces, which pass through the shredding device and are resent to the inlet opening of the shredding device, the waste pieces and wires left in the drum body 23 can be sent directly to the inlet opening without using transporting means for the shredding pieces and so on. As a result, feeding and re-shredding can be continuously carried out smoothly. Of course, the shredding device 1 is not absolutely required to be placed inside the rotary screening drum 2.

In the shredding device 1 shown in FIG. 4, there are two stages each formed of the upper and lower rotary shredding cutters 9 and 11 or 10 and 12, but one or three or more stages of shredding cutters may of course be employed. The blade elements 9*b*1 to 12*b*1 of the shredding blades 9*b* and 12*b* each have the replacement blades 17, but the blade element has not necessarily to be replaced. Furthermore, the structure of the blade element should not be limited to those illustrated.

Figure 25:
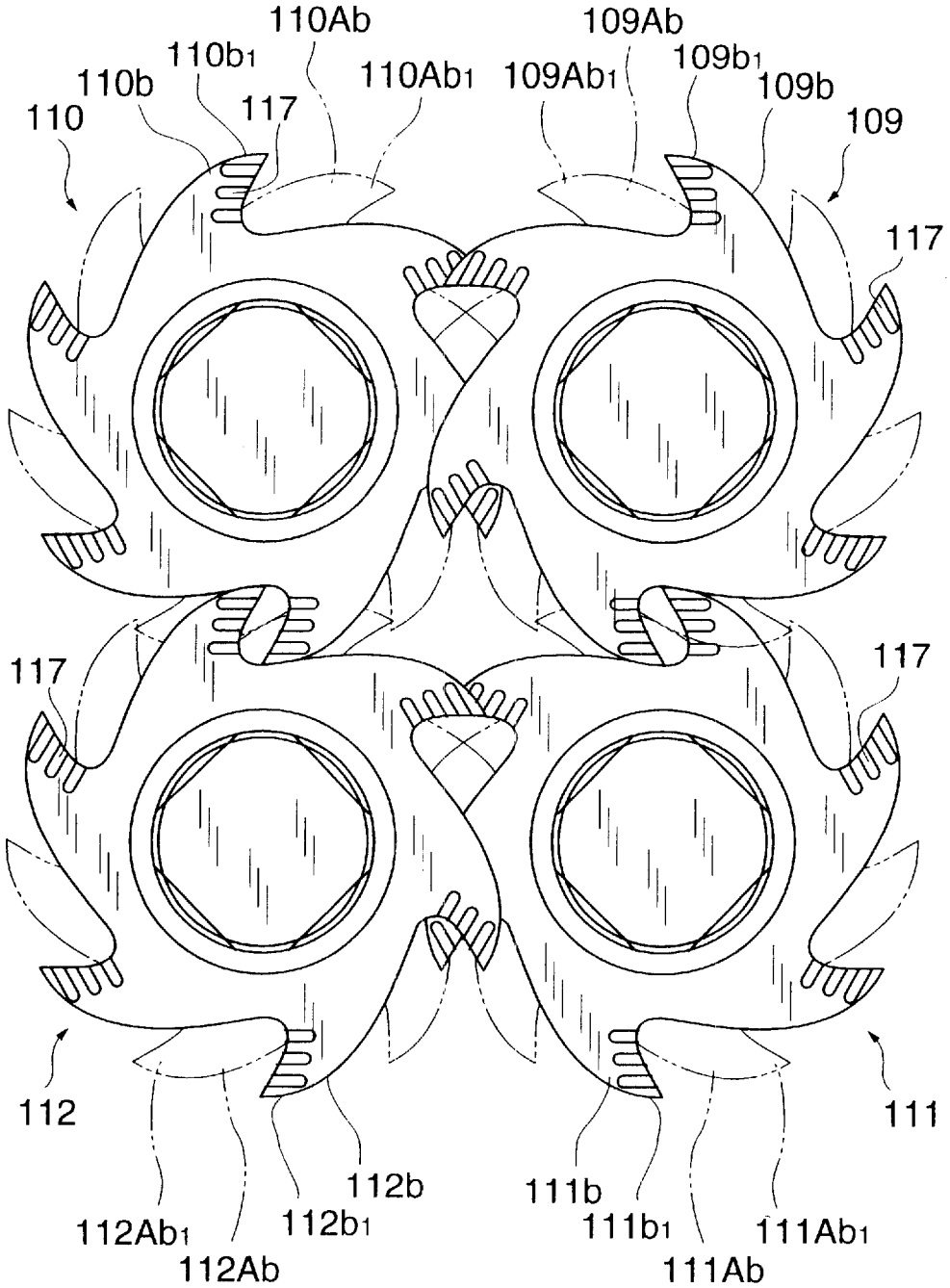
FIG. 25 is an enlarged side view showing another embodiment of the paired rotary shredding cutters on the upper and lower sides of the apparatus according to the invention.

The shredding section may be composed of the rotary shredding cutters 109, 110, 111 and 112 shown in FIG. 25. The rotary shredding cutters 109 to 112 are equivalent to the rotary shredding cutters 9 to 12, and accordingly, the description of these component parts is omitted below to avoid repetition.

For example, in the rotary shredding cutter 109, the blade element 109*b*1 of the shredding blade 109*b* shown by the solid line in FIG. 25 is displaced relative to the adjacent blade element 109A*b*1 of the shredding blade 109*b* shown by the chain line by a certain angle. Thus, the rotary shredding cutter 109 is composed of a plurality of blade elements adjacent in the axial direction, which are sequentially displaced by the prescribed angle in the rotational direction. Each of blade elements 109*b*1, 109A*b*1, 110*b*1, 110A*b*1, 111*b*1, 111A*b*1, 112*b*1 and 112A*b*1 is not provided with such a replacement blade 17 as seen in FIG. 15, but has grooves 117 on both sides, which serve the same function as the grooves 17*a* formed in the aforementioned replacement blade 17.

In the rotation driving means 3, the rotary screening drum 2 in the embodiment shown in FIG. 4 is rotated by using the guide members 25 and feed wheels 35 (FIG. 32), but this structure is not specifically limited thereto. Instead of these components, a transmission belt running through around the rotary screening drum and the rotating shaft of the motor may of course be used.

The screening device has the rotary screening drum 2 as shown in FIG. 4, but may of course be of a rotary screening drum formed in a cylinder. In the case of using the cylindrical screening drum, the screening device may be installed at a different position from that shown in FIG. 4, so as to introduce the waste tire pieces (shredded chips) discharged from the shredding device 1 through the outlet opening 8 into the drum by use of the collection means 4. It is a matter of course that the screening device is not limited to the drum type.

Next, the shredding device 201 shown in FIG. 26 and FIG. 27 will be described.

The shredding device 201 is provided with a first shredding member 209 and a second shredding member 210, which constitute the shredding section. In the illustrated embodiment, the first shredding member 209 is stationary, and the second shredding member 210 is movable. The stationary shredding member 209 and the movable shredding member 210 are provided on their opposite faces with shredding blades 209*b* and 210*b*. The shredding blades 209*b* and 210*b* are provided on their opposite faces with blade elements 209*b*1 and 210*b*1. The movable shredding member 210 is movable along the face opposite to the stationary shredding member 209 (in the up-and-down direction in FIG. 26) by use of driving means. Between the blade element 209*b*1 of the shredding blade 209*b* and the blade element 210*b*1 of the shredding blade 210*b* facing the blade element 209*b*1, there is formed a space 213 for accommodating the waste tire pieces to be shredded. The waste tire pieces with wires are introduced into between the opposite blade elements 209*b*1 and 210*b*1 and shredded with the cooperation of the blade elements 209*b*1 and 210*b*1.

The opposite blade elements 209*b*1 and 210*b*1 each have a plurality of grooves 217*a* in their surfaces opposite to each other. The waste tire piece entering in the space 213 is partially caught by the grooves 217*a*. The groove 217*a* is formed like a slit in the illustrated embodiment, and extends perpendicular to the direction in which the movable shredding member 210 moves (up-and-down direction in FIG. 26).

The driving means for moving the movable shredding member 210 comprises a motor 246, a rotating wheel 248, and a transmission belt 247 for transmitting rotational motion of the motor 246 to the rotating wheel 248. A crank arm 249 has one end connected to the upper portion of the back of the movable shredding member 210, and a connection arm 251 has one end connected to the lower portion of the back of the movable shredding member 210. The other end of the crank arm 249 is connected to an eccentric pin 250 fixed on the rotating wheel 248. The other end of the connection arm 251 is connected to a pin fixed on a support 252. As the motor 246 is driven to rotate the rotary wheel 248 through the medium of the transmission belt 247, the movable shredding member 210 is rocked up and down in the directions indicated by the arrow in FIG. 26 with eccentric movement of the eccentric pin 250.

Thus, the waste tire piece introduced into the space 213 through the inlet opening 207 is smashed into small pieces with the rocking movement of the shredding blade 210*b* of the movable shredding member 210 relative to the shredding blade 209*b* of the stationary shredding member 209. Also, the entire or part of piece cut out from the waste tire piece is torn off by the relative movement of the blade elements 209*b*1 and 210*b*1. The cut piece of the waste tire, which is partially caught by the grooves 217*a*, is strongly pulled up and down to be torn off into two chips by virtue of the shearing forces exerted on the cutting plane thereof in opposite directions, and simultaneously, the wire in the cut piece is separated from the smashed chips. The same shredding action takes place in the space 213 while forwarding the waste tire pieces toward an outlet port 208 in a hopper 253 until resultant smashed chips and wires are discharged into the outlet port 208.

Figure 26:
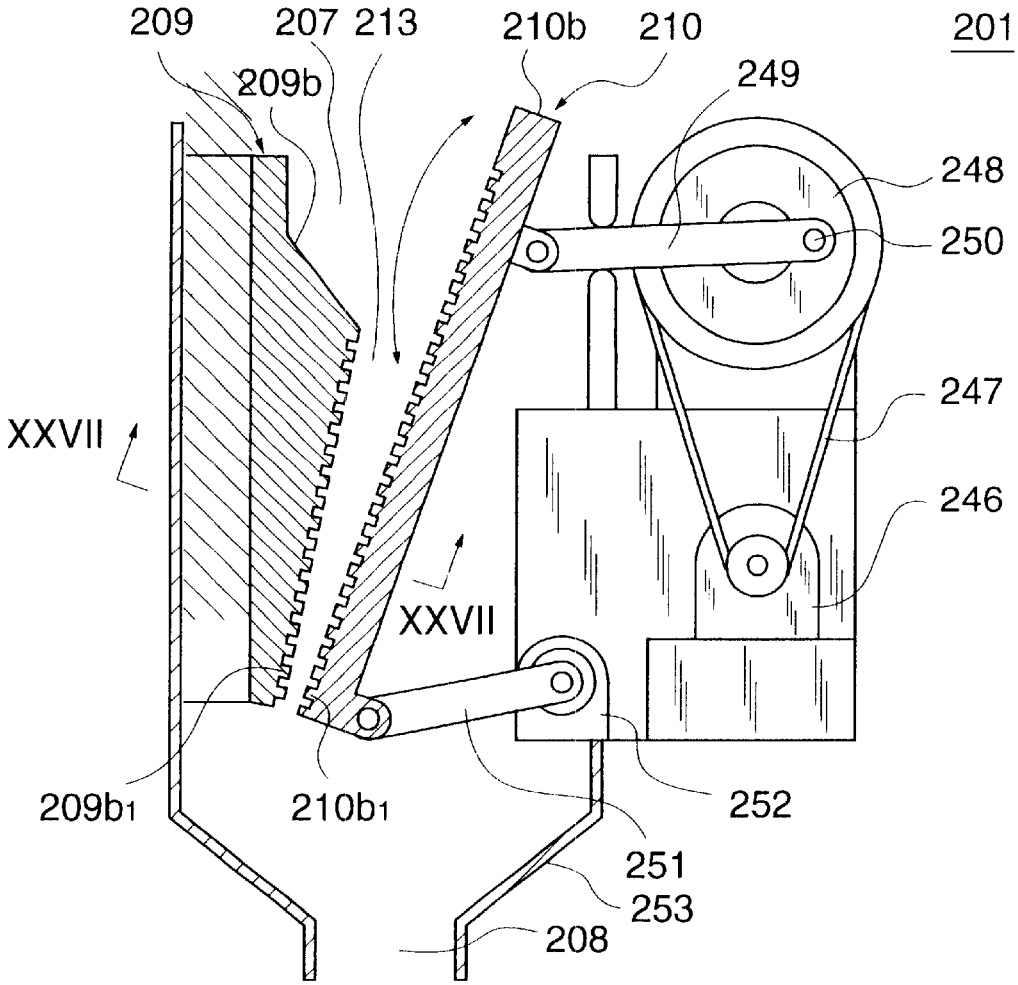
FIG. 26 is a schematic view of the structure of still another embodiment of the shredding device according to this invention.
Figure 27:
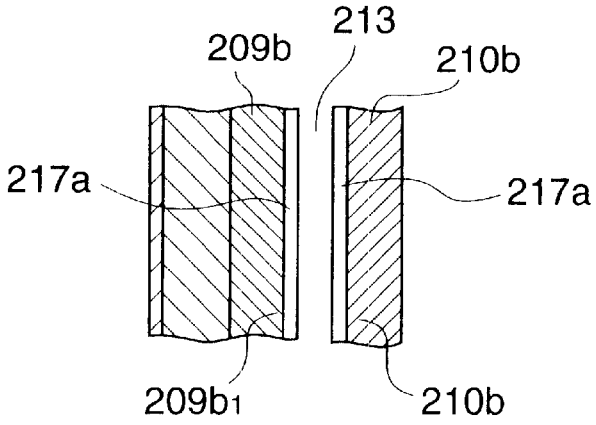
FIG. 27 is a cross section taken on line XXVII—XXVII in FIG. 26.

In the shredding device 201 shown in FIG. 26, the shredding blades 209*b* and 210*b* of the rotary shredding cutters 209 and 210 correspond to the shredding blades 409*b* and 410*b* shown in FIGS. 1A, 1B, 2A, 2B, 3A and 3B, and the blade elements 209*b*1 and 210*b*1 correspond to those 409*b*1 and 410*b*1, respectively. The space 213 in this embodiment corresponds to the space 413.

The second shredding member 210 is movable in the shredding device 201 shown in FIG. 26, but the first shredding member 209 may be movable, too. Inversely, the first shredding member 209 may be movable, and the second shredding member 210 may be stationary.

In the illustrated embodiment, the groove 217*a* formed in the respective blade elements extends perpendicular to the moving direction of the second shredding member 210, but it is not absolutely required to be exactly perpendicular to the moving direction of the second shredding member, and may assume a large angle relative to the moving direction of the second shredding member.

Next, another shredding device 301 will be explained with reference to FIG. 28 and FIG. 29.

The shredding device 301 comprises a first shredding member 309 and a second shredding member 310, which constitute the shredding section. In the illustrated embodiment, the first shredding member 309 is stationary, and the second shredding member 310 is movable. The stationary shredding member 309 is formed into a substantially cylindrical shape widening downward, namely, assume a general conical shape. The stationary shredding member 309 and movable shredding member 310 have shredding blades 309*b* and 310*b* opposite to each other. On the opposite faces of the shredding blades 309*b* and 310*b*, there are formed blade elements 309*b*1 and 310*b*1. The movable shredding member 310 can rotate along the opposite face of the stationary shredding member by driving means. Between the blade element 309*b*1 and the blade element 310*b*1 of the shredding blade 310*b* facing the blade element 309*b*1, there is formed a space 313 for accommodating the waste tire pieces to be shredded. The waste tire pieces with wires are introduced into between the opposite blade elements 309*b*1 and 310*b*1 and shredded with the cooperation of the blade elements 309*b*1 and 310*b*1.

The opposite blade elements 309*b*1 and 310*b*1 each have a plurality of grooves 317*a* in their surfaces opposite to each other. The waste tire piece entering in the space 313 is partially caught by the grooves 317*a*. The groove 317*a* is made of a slender slot in the illustrated embodiment, and extends cross the rotational direction of the movable shredding member 310 (perpendicular direction in the drawing).

The driving means for moving the movable shredding member 310 comprises a motor 346 with a rotating shaft 347 rotated by the motor. The movable shredding member 310 is attached to the rotating shaft 347 of the motor. With the rotational motion of the motor 346, the movable shredding member 310 rotates in the direction indicated by the arrow in FIG. 28.

Accordingly, the cut pieces of the waste tire introduced into the inlet opening 307 are first smashed by the shredding blades 309*b* of the rotary shredding cutters 309 and the shredding blades 310*b* of the rotary shredding cutters 310, and then, the pieces including chips smashed by the shredding blades 309*b* and 310*b* enter into the space 313 and there sheared into fine chips with the cooperation of the movable and stationary shredding members. The cut pieces of the waste tire are partially caught by the grooves 317*a* and exposed to shearing force brought about by the movable shredding member moving relative to the stationary shredding member, so that the cut pieces are torn into fine pieces, and simultaneously, wires joined to the cut pieces are separated from the pieces. The same shredding action takes place while forwarding the waste tire pieces toward an outlet 308 in a hopper 353 until resultant smashed chips and separated wires are discharged into the outlet 308.

Figure 28:
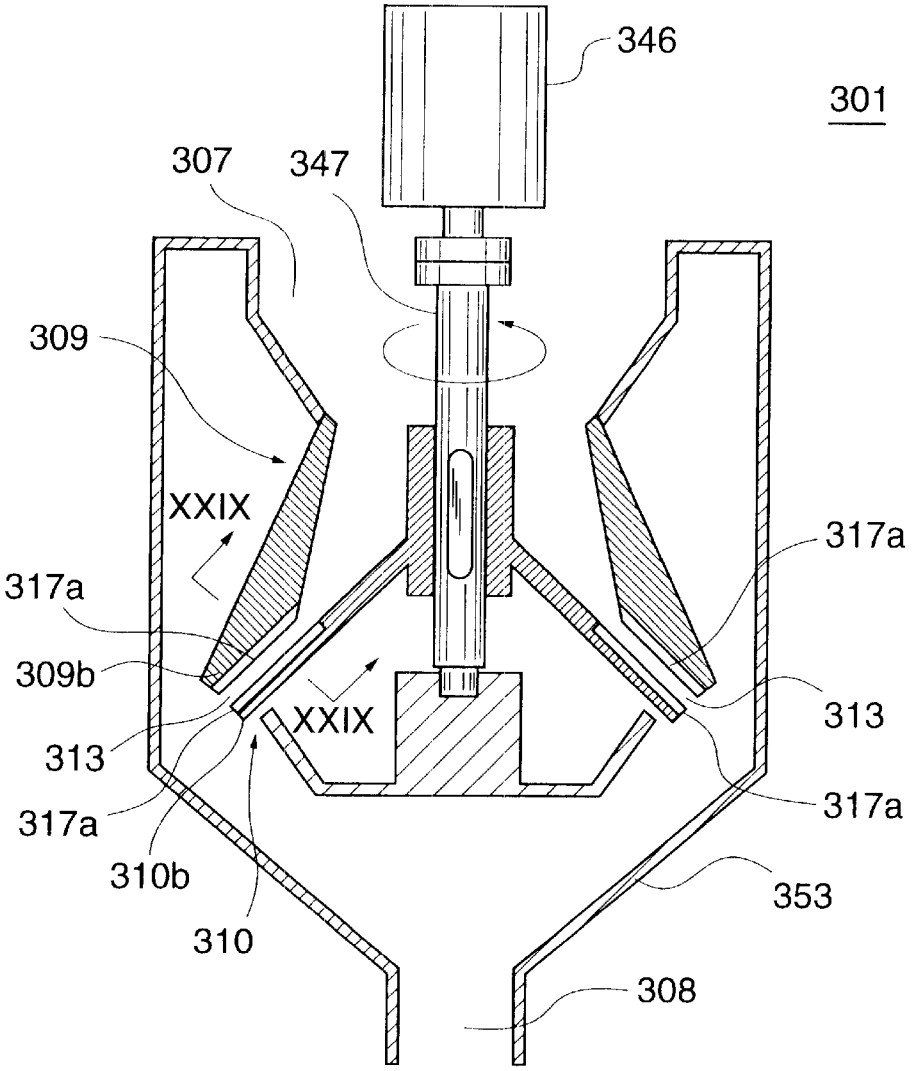
FIG. 28 is a schematic view of the structure of yet another embodiment of the shredding device according to this invention.
Figure 29:
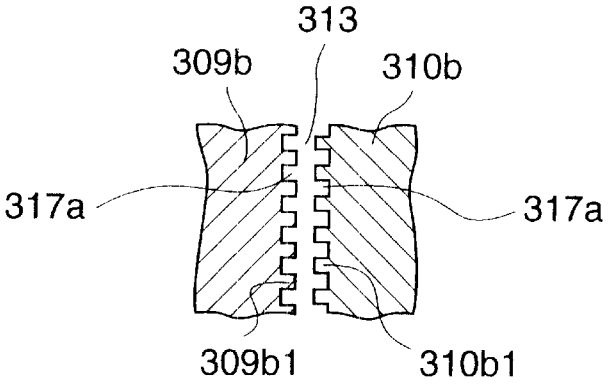
FIG. 29 is a cross section taken on line XXIX—XXIX in FIG. 28.
Figure 30A:
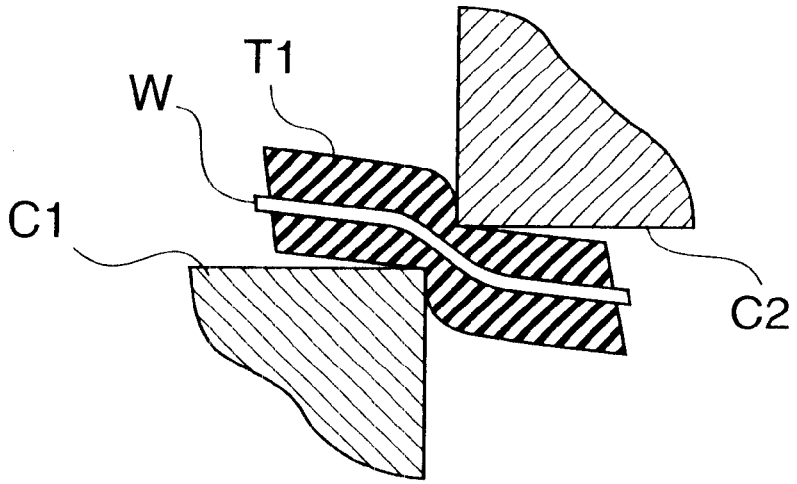
FIG.30A PRIOR ART
FIGS. 30A and 30B are views explanatory of a conventional method for shredding a waste tire.
Figure 30B:
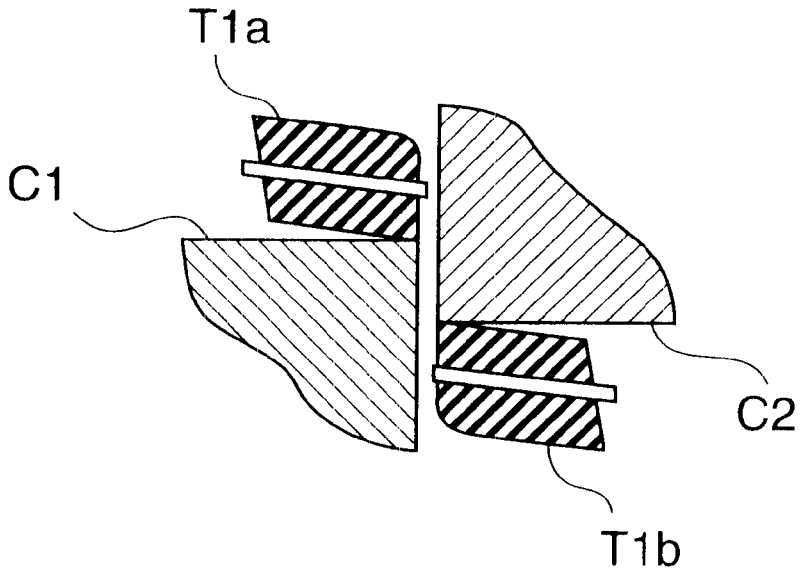
FIG.30B PRIOR ART

In the shredding device 301 shown in FIG. 28, the shredding blades 309*b* and 310*b* correspond to the shredding blades 409*b* and 410*b* shown in FIGS. 1A, 1B, 2A, 2B, 3A and 3B, the blade elements 309*b*1 and 310*b*1 correspond to those 409*b*1 and 410*b*1, and the space 313 corresponds to the space 413, respectively.

Only the second shredding member 310 is movable in the shredding device 301 shown in FIG. 28, but the first shredding member 309 may be movable, too. Inversely, the first shredding member 309 may be movable, and the second shredding member 310 may be stationary.

The grooves 317*a* formed in the respective blade elements in the illustrated embodiment extend perpendicular to the moving direction of the second shredding member 310, but it is not absolutely required to be exactly perpendicular to the moving direction of the second shredding member, and may assume a large angle relative to the moving direction of the second shredding member.

The waste matter to be processed in the shredding devices 101, 201 and 301 as described above includes not only a scrap of waste tire, but also, for instance, household electrical appliances, large household furniture, containers, machines and so on. It is a matter of course that the apparatus of the invention can readily deal with waste tire pieces composed of rubber to merely tear off the rubber-only pieces into fine chips.

According to the present invention, since the shredding device of the invention makes use of the shredding space formed of the shredding members and the shearing grooves formed in the shredding elements of the shredding members, any kind of substance, matter or material can be quickly shredded or torn off with high efficiency, even foreign substance such as metal wires embedded in a waste matter can easily be sorted out and separated from the shredded pieces of the waste tire, and the labor required to break up the waste matter can be abridged and the efficiency and rationality of fulfilling disposal of waste matter can be enhanced.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. A method for disposing of waste matter by relatively moving a first shredding member and a second shredding member, said first and second shredding members having shredding blades provided in their opposite faces with grooves, comprising placing said waste matter in a space between the shredding blades of said first and second shredding members, and catching parts of said waste matter by said grooves formed in said shredding blades in shredding said waste matter with relative movement of said first and second shredding members, said grooves being open to said space.

2. A method as set forth in claim 1, wherein said waste matter to be shredded is a waste tire piece and shredded into rubber chips and wire chips while being partially caught by said grooves formed in said shredding blades.

3. A method as set forth in claim 1, wherein said first and second shredding members rotate relatively in opposite directions to shred the waste matter in said space between said shredding blades adjacent to each other.

4. A method as set forth in claim 3, wherein said waste matter is partially caught by said grooves, each of said grooves being open toward a direction in which said shredding member rotates.

5. A method as set forth in claim 1, wherein shredded pieces into which said waste matter is shredded in said space between said shredding blades are sorted out in accordance with a screening size, and the shredded pieces greater than said screening size are again shredded by said shredding blades.

6. An apparatus for disposing of waste matter, comprising a shredding section including a first shredding member and a second shredding member, at least one of said first and second shredding members being movable relative to the other, said first and second shredding members having shredding blades for cooperatively shredding the waste matter, said shredding blades of said first and second shredding members being opposite to each other to form a space therebetween for accommodating the waste matter to shred the waste matter with said shredding blades and having opposite faces with grooves for permitting the waste matter to be partially caught.

7. An apparatus as set forth in claim 6, wherein said first shredding member and said second shredding member are rotatable in opposite directions relative to each other, and said shredding blades of one of said first and second shredding members are arranged between said shredding blades of the other shredding member so that said shredding members of said first and second shredding members are adjacent to one another at intervals.

8. An apparatus as set forth in claim 7, wherein each of said grooves has one end opening toward a direction in which said shredding member rotates, and the other end closed.

9. An apparatus as set forth in claim 6, wherein said first and second shredding members are rotary shredding cutters rotatable about their rotating shafts in opposite directions relative to each other, said rotary shredding cutters being provided with shredding blades arranged on the rotating shafts at intervals, said shredding blades of one of said rotary shredding cutters being placed between said shredding blades of the other of the rotary shredding cutters so as to cooperate with one another to shred the waste matter, said shredding blades of said rotary shredding cutters being adjacent to each other to form said space therebetween for accommodating the waste matter to shred the waste matter with said shredding blades and having said opposite faces with said grooves.

10. An apparatus as set forth in claim 9, wherein each of said grooves has one end opening toward a direction in which said shredding member rotates, and the other end closed.

11. An apparatus as set forth in claim 9, wherein said rotary shredding cutters are placed vertically to form a plurality of stages of shredding cutters.

12. An apparatus as set forth in claim 6, wherein said shredding blades are provided with replacement blades detachable from said shredding blades.

13. An apparatus as set forth in claim 6, further comprising a rotary screening drum, in which said shredding section is placed.

14. An apparatus as set forth in claim 13, wherein said shredding section is provided in its upper side with an inlet opening for introducing the waste matter into said shredding section and in its lower side with an outlet opening for discharging the waste matter processed in said shredding section to said rotary screening drum therethrough, said rotary screening drum being provided with a plurality of screening perforations, so as to send back the waste matter prevented from passing through said screening perforations to said inlet opening.

15. An apparatus as set forth in claim 6, wherein one of said first and second shredding members is stationary, and the other of said first and second shredding members is movable relative to a face of said shredding blade of said stationary shredding member by drive means.

16. An apparatus as set forth in claim 6, wherein one of said first and second shredding members is stationary, and the other of said first and second shredding members is rotatable relative to a face of said shredding blade of said stationary shredding member by drive means.

* * * * *